US008719971B2

(12) United States Patent
Burt et al.

(10) Patent No.: US 8,719,971 B2
(45) Date of Patent: May 13, 2014

(54) LAVATORY DISPENSING DEVICES

(75) Inventors: Diane Joyce Burt, Montvale, NJ (US); Daniel Genord, Walled Lake, MI (US)

(73) Assignee: Reckitt Benckiser LLC, Parsippany, NJ (US)

( * ) Notice: Subject to any disclaimer, the term of this patent is extended or adjusted under 35 U.S.C. 154(b) by 466 days.

(21) Appl. No.: 13/054,172

(22) PCT Filed: Jun. 12, 2009

(86) PCT No.: PCT/GB2009/001474
§ 371 (c)(1),
(2), (4) Date: May 4, 2011

(87) PCT Pub. No.: WO2010/007337
PCT Pub. Date: Jan. 21, 2010

(65) Prior Publication Data

US 2011/0219525 A1 Sep. 15, 2011

(30) Foreign Application Priority Data

Jul. 18, 2008 (GB) ..... 0813167.4

(51) Int. Cl.
*E03D 9/00* (2006.01)
*E03D 9/03* (2006.01)

(52) U.S. Cl.
CPC . *E03D 9/037* (2013.01); *E03D 9/03* (2013.01)
USPC ..... 4/225.1

(58) Field of Classification Search
CPC ..... E03D 9/022; E03D 9/03; E03D 9/031; E03D 9/037
USPC ..... 4/225.1, 226.1, 227.6, 227.7
See application file for complete search history.

(56) References Cited

U.S. PATENT DOCUMENTS

| | | | |
|---|---|---|---|
| 3,105,245 | A | 10/1963 | Finkbiner |
| 5,042,095 | A | 8/1991 | Schoepe et al. |
| 5,603,126 | A | 2/1997 | Scoggins |
| 5,778,459 | A | 7/1998 | Guerin |
| 5,815,850 | A | 10/1998 | Shon |
| 6,341,385 | B1 | 1/2002 | Downes |
| 2003/0121089 | A1 | 7/2003 | Nguyen |

FOREIGN PATENT DOCUMENTS

WO 2007149365 A2 12/2007

*Primary Examiner* — Tuan N Nguyen
(74) *Attorney, Agent, or Firm* — Norris McLaughlin & Marcus PA

(57) ABSTRACT

The present invention relates to improved toilet dispensing devices for use in conjunction with a sanitary appliance, particularly a toilet.

11 Claims, 5 Drawing Sheets

LAVATORY DISPENSING DEVICES

Figure 1:
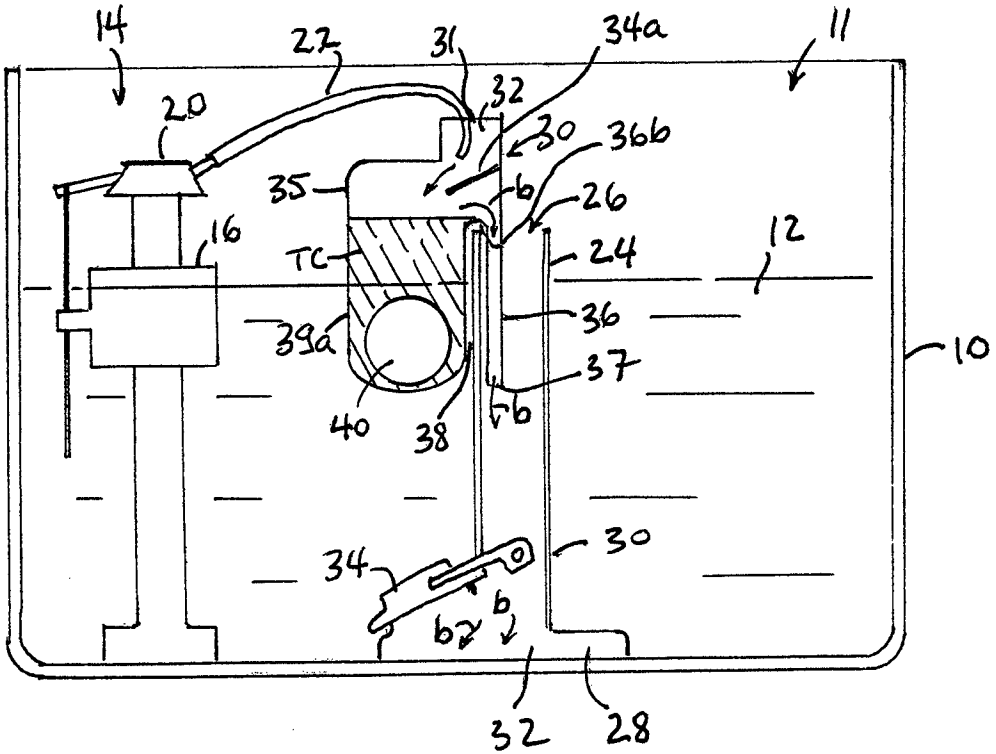

This is an application filed under 35 USC 371 of PCT/GB2009/001474.

The present invention relates to improved lavatory dispensing devices. More particularly the present invention relates to improved lavatory dispensing devices which are useful in conjunction with a toilet cistern, as well as a method for delivering a treatment composition to a toilet bowl in toilets provided with a cistern. The said treatment composition contains one or more chemical constituents e.g., coloring agents, cleaning agents, disinfecting agents, anti-lime scale agents which are provided with the dispensing devices. The treatment composition is formed by water contacting the chemical constituents of the device coming into contact with the one or more chemical constituents, which are released into the bowl of the toilet.

Since the advent of sanitary appliances and in particular modern flush toilets, there has been a continuing need in the art to provide effective ways to maintain these appliances in a satisfactory condition between uses. The art is replete with devices which are intended to be used as "in the bowl" (or ITB) or "in the cistern" (or ITC) in order to provide a coloring and/or cleaning and/or fragrancing and/or sanitizing effect to such sanitary devices, particularly toilet bowls.

One common approach known to the art is to provide a device which is at least immersed within the cistern or tank of a toilet, which may be either placed wholly within the interior of the toilet such as by placement at the bottom of a toilet tank so that the entire device is wholly immersed in water when the tank is full, or is at least partially immersed within the water present in a toilet tank, such as wherein such a device is suspended from a part of the toilet tank, such as a lip or rim of the tank. Such are generally referred to as ITC devices.

A shortcoming of such ITC devices known to the art resides in the fact that they are frequently totally immersed in the water present in the cistern. Two technical shortcomings frequently result from such immersed ITCs. First, the compositions of an ITC are difficult to formulate as many constituents which are desirably present in such lavatory blocks such as many surfactants, particularly higher foaming surfactants including anionic surfactants, are also water soluble or water dispersible. Thus when a solid lavatory block containing surfactants, particularly higher foaming surfactants are immersed in water for a period of time, often the presence of such surfactants undesirably softens the immersed block and reduces the performance characteristics of the block over time, and may even lead to diminish lifespan due to premature dissolution of the solid lavatory block. While this problem may be addressed by the use of different surfactants which are more hydrophobic, such more hydrophobic surfactants are also recognized in the art as having reduced cleaning and/or foaming. Further, the compositions of an ITC block may include constituents such as an active source of oxygen, such as an oxidant compound or composition such as bleach, the presence of the oxidant in the standing water of the toilet cistern frequently chemically attacks any metal parts which are also present in the standing water of the cistern and may induce corrosion, and premature failure of any mechanism which comprises such metal parts. Prominently, flushing mechanisms for releasing or dispensing water to be flushed from the cistern to the toilet, and/or cistern refill devices for refilling the toilet cistern following a flush cycle come into consideration. While this problem may be addressed by the inclusion of corrosion inhibiting compounds or compositions in lavatory block composition adapted to be used in an ITC, or as an ITC, such increases the complexity of such a lavatory block formulation as well as its cost.

A further technical problem in the art resides in the fact that during the flush cycle of a toilet, the quantity of water present in the cistern is released into the toilet bowl via one or more fluid passages which provide a fluid conduit between, which while effective in providing a treatment composition such as it intended to provide a general cleaning and/or sanitizing/disinfecting benefit to the toilet bowl consequence from the contact of the water provided by the flush cycle, this lime of water containing such a treatment composition or forming a treatment composition is essentially evacuated at the conclusion of the flush cycle and passes to the drain lines, with little if any essentially remaining within the interior of the toilet bowl. Add her to the conclusion of the flush cycle, and during the refilling of the cistern, typical devices provide water to fill the bottom of the toilet bowl, also referred to as the "sump" was a quantity of fresh water which supplied via a refill device. Such a refill device is well known in the art comment typically resides within the interior of the cistern. The refill device typically includes a float mechanism which rises or falls with the level of water within the cistern, which float mechanism is usually affixed via an intermediate linkage to a cutoff for a fill valve. When the cistern is emptied of its contents, the float drops, actuating the refill device such that a major proportion of water from a supply line is directed to the interior of the cistern, while at a secondary minor proportion of the water being supplied it is passed through an overflow conduit, said overflow tube having one and inserted into the standpipe of a flush valve, also known as the overflow tube. This secondary minor proportion of water is supplied to the interior of the standpipe of the flush valve, and passes through the base of the flush valve and into the toilet bowl. As the refill device operates, water is supplied to the interior of the cistern as well as to the overflow conduit and into the standpipe of the flush valve, during which process, referred to as a "refill cycle", the rising level of water within the cistern closes the float mechanism to rise due to its buoyancy with respect to this water, and ultimately when an appropriate level of water is supplied to the cistern, the cutoff for the fill valve operates and terminates the flow of water to both the interior of the cistern, as well as through the overflow tube. Typically, the appropriate level of water is a sufficient volume of water wherein the top level or top surface of the water within the cistern is below the open end at the top of the overflow tube. During this process, it is to be appreciated in that a major proportion of the water being supplied via the overflow conduit and downwardly through the overflow tube is retained within the sump of the toilet bowl.

U.S. Pat. No. 6,240,572 provides a device useful in the sanitization of a toilet. As it is seen from that document, the main body of said device is substantially cylindrical and comprises a plurality of stacked sanitizing tablets therein. Further, the inlet to the main body is at the base thereof, and as can be seen from the figure this impedes the flow of water being provided from a conduit which must then pass about the peripheral margins of the stacked sanitizing tablets and operate against the force of gravity. Thus the interior of the device is pressurized during the flow of water through the main body of the device else it would not flow upwardly. As a visible from the depiction, the stacked sanitizing tablets have essentially the same cross-sectional diameter as the interior cross-sectional diameter of the substantially cylindrical main body of said device, and it is foreseen that such will deleteriously affect the fluid flow of water being supplied to the interior of said device. It is expected that any erosion of said stack of sanitizing tablets will occur beginning with the base tablet and as the stack of sanitizing tablets are sequentially eroded, the next vertically positioned tablet will fall downwards to the bottom of the device and continue to block the inlet to the main body. Such impedes the fluid flow passing through this prior art device in an unsatisfactory manner, and requires pressurization.

Thus, there exists a real and urgent need in the art for improved lavatory dispensing devices which are particularly well adapted to be positioned in a toilet cistern, viz., an ITC device, as well as a method of making such an ITC device as well as methods for the treatment of a toilet bowl via the use of such an improved ITC device.

The present invention, in its various aspects, provides a lavatory dispensing device useful for the delivery of at least one treatment composition, preferably a cleaning composition and/or a sanitizing composition to a sanitary appliance, e.g. a toilet bowl. The device is used as an ITC type device.

According to a first aspect of the invention there is provided an improved lavatory dispensing device comprising a treatment composition adapted to be mounted on the overflow tube of a toilet or other lavatory appliance.

In a second aspect of the invention there is provided a process for treating a sanitary appliance, especially a toilet, with the improved lavatory dispensing device described herein.

In a third aspect there is provided a method for the manufacture of the improved lavatory dispensing devices described herein.

These and other aspects of the invention will be more evident from a reading of the following specification.

Broadly defined, the present invention provides a non-pressurizable lavatory dispensing device comprising a hollow body having an inlet located along or at the top surface of the device which inlet is open to the ambient environment of the lavatory appliance, viz., toilet, in which it is installed, and an outlet also open to the ambient environment of the lavatory appliance, viz., toilet, in which it is installed, said hollow body defining an interior cavity which is adapted to contain a quantity, e.g, a mass, of a chemical treatment composition as well as a quantity of a liquid, especially water, provided to the interior of said hollow body via the inlet, wherein the output of the device is adapted to be inserted at least partially into the interior of an overflow tube present in the cistern of a toilet (or other sanitary appliance) and whereby the said hollow body is suspended downwardly from the top open end of the overflow tube. In particularly preferred embodiments, the lavatory dispensing device is of a sealed construction and cannot be opened by a consumer or other user once the lavatory dispensing device is assembled, and thus excludes a cap or other element which provides for easy access into the interior of the lavatory dispensing device, particularly to the hollow body. The interior cavity is in fluid communication with both the inlet, and with the outlet. In certain preferred embodiments, the inlet and the outlet are both located at one side of the hollow body with the inlet being separated from the outlet by a flow diverter means such as an internal diverter plate which directs the flow of any liquid being supplied via the inlet into the hollow cavity which contains the chemical treatment composition. In certain preferred embodiments, the inlet and/or the outlet are unobstructed by the chemical treatment composition present within the hollow body, and in particularly preferred embodiments both the inlet and the outlets are unobstructed by the chemical treatment composition present within the interior, especially within the interior cavity of the lavatory dispensing device. In preferred embodiments inlet of the device may form an upwardly directed tube or leg which provides for fluid communication between an open end of the inlet, with the hollow cavity in the interior of the device, and the outlet of the device may form a downwardly directed tube or let which provides for fluid communication between the hollow cavity in the interior of the device, and an open end of the outlet. The inlet and the outlet may be considered to have a center line or center axis which is along the flow direction of the water passing therethrough these respective elements; in certain embodiments the center line or center axis of the inlet coincides with the center line or center axis of the outlet, in certain further embodiments the center line or center axis of the inlet are parallel to but non-coincident with the center line or center axis of the outlet, while in still further embodiments the center line or center axis of the inlet is angled with respect to the center line or center axis of the outlet, wherein such angle is preferably not more than 90°, and in order of increasing preference is not more than 85°, 80°, 70°, 60°, 50°, 45°, 40°, 35°, 30°, 25°, 20°, 15°, 10°, and 5°.

In certain and preferred embodiments of the lavatory dispensing device of the invention, said device may also include a flow diverter means such as an internal diverter plate which directs the flow of any liquid being supplied via the inlet into the hollow cavity which contains the chemical treatment composition. Such a flow diverter means is not essential in all embodiments of the device, but is conveniently included in this present within the interior of the device particularly wherein that the center line or center axis of the inlet coincides with the center line or center axis of the outlet, ask them in the absence of such a flow diverter means liquid, viz., water entering the device of the in liquid flowed directly downwardly and exit the device via the outlet, without coming into contact with the hollow cavity and the chemical treatment composition contained therein. The form of the flow diverter means can take any shape or configuration which is suitable to provide such an effect, and indeed many in certain embodiments be considered to form an integral part of the inlet part of the device. Conveniently, the flow diverter means is in the form of a flat or curved elements such as a flat or curved plate which redirects the direction of flow of the liquid entering the device through the open end of the inlet such that it is forced to enter the hollow cavity prior to exiting the hollow cavity via the outlet of the device. In such a manner, delivery of liquid composition so that it can come in contact with the chemical treatment composition can be reliably assured. A diverter means however can be omitted where the configuration of the devices such that the direction of liquid, viz. water entering the inlet is forced to pass through at least a portion of the hollow cavity prior to exiting via the outlet, such as wherein the center line or center axis of the inlet are non-coincident with the center line or center axis of the outlet.

The present inventors have also found that the hollow cavity of the lavatory dispensing device should have an adequate volume which is sufficient to contain with its interior both the chemical treatment composition as well as a sufficient quantity of a liquid, namely water, which is retained within the hollow cavity and intimate contact with the chemical treatment composition between flush cycles on the toilet. The retention of the water in such a manner permits for the formation of a lavatory treatment composition which is formed by the dilution, dissolution, diffusion, elution and/or solubilization of at least one or more chemical compounds from the chemical treatment composition into the water present within the hollow cavity, particularly the water which is retained within the hollow cavity between flush cycles. This forms a "concentrate" form of the lavatory treatment composition as it will be appreciated that the retention time of the water within the hollow cavity for a longer period of permits for the dilution, dissolution, diffusion, elution and/or solubilization of a portion of the chemical treatment composition into this quantity of water which is essentially static. Yet, upon the actuation of the refill device of the lavatory appliance, a quantity of water is supplied to the interior of the lavatory dispensing device via its inlet, where said water flows into the hollow cavity and forces the concentrate form of the lavatory treatment composition outwardly through the outlet of the lavatory treatment device. This quantity of the concentrate form of the lavatory treatment composition is usually substantially retained within the sump of the toilet bowl wherein it may provide a cleaning and/or sanitizing and/or disinfecting benefit to the toilet bowl. During the refilling of the cistern, the refill device acts to continuously provide a quantity of water which passes into the hollow cavity and comes into contact with the chemical treatment composition and forms a less concentrated but still effective lavatory treatment composition which flows outwardly through the outlet ending to the overflow tube and into the sump of the toilet bowl during the operation of the refill device. Such supplements the quantity of the concentrate form of the lavatory treatment composition is usually substantially retained within the sump. At the conclusion of the refill cycle, the refill device concludes its operation and any water provided through the inlet is retained within the interior of the hollow cavity and in contact with the chemical treatment composition, where it may remain in an essentially static state and operates to dilute, dissolve, diffuse, elute and/or solubilize a portion of the chemical treatment composition and form a next quantity of a concentrate form of the lavatory treatment composition, which will be released upon the next flush cycle of the toilet. This foregoing process repeats itself continuously upon each flush cycle until the chemical treatment composition present within the device is fully exhausted or consumed.

The inventors have found that desirably, at least a minimum volumetric ratio or volumetric proportion between the chemical treatment composition present within the interior of the device, particularly within the hollow cavity, and the quantity of water which is retained within the hollow cavity and in contact with the chemical treatment composition between flush cycles needs to be maintained in order to ensure the delivery of an effective lavatory treatment composition to the sump of the toilet (or other lavatory appliance) during the flush cycle. This is particularly true wherein a concentrate of the lavatory treatment composition is formed and first exits the device during the flush cycle. Furthermore, the present inventors have found that the flow of water between the inlet, through the hollow cavity, and out of the outlet of the lavatory treatment device unimpeded by flow restricting passages defined as any space or passage between a side wall of the device and the exterior of the chemical treatment composition provides for effective operation thereof. In accordance with preferred embodiments of the invention, the water passing through the inlet and into the interior of the hollow cavity enters the hollow cavity at a point above the master quantity of the chemical treatment composition and is not required to pass this mass or body of the chemical treatment composition before exiting via the outlet of the device. Rather, the flow of water passes into the filled volume of the cavity within the interior of the device. This filled volume is as the maximum quantity of the liquid, namely water, which may be contained within the interior of the lavatory treatment device when it is appropriately mounted upon an overflow tube. Typically, this filled volume corresponds to the volume of the hollow cavity which exists between the base of the device and extends upward towards the top of the device to the level of the base of the outlet of the lavatory treatment device. This filled volume can be readily determined by mounting the lavatory treatment device onto an overflow tube in its normal operating position, and filling the hollow cavity up to the point with liquid in an amount sufficient to fill the bottom part of the hollow cavity but not in amount wherein said liquid flows out through the outlet of the device. As will be appreciated, this bottom part of the hollow cavity defines the maximum volume of static water which can be contained within the lavatory treatment device, while the upper part of the cavity defines the headspace of the hollow cavity which is open to the ambient atmosphere within the interior of the cistern before, during, and after a flush cycle of the toilet. In preferred embodiments, the respective volumetric ratio between the chemical treatment composition, and the static water within the interior of a hollow cavity where and both are simultaneously present is at least 1:2 and preferably is at least 1:1. The inventors of found that an insufficient respective volumetric ratio between the chemical treatment composition and the static water may result in the formation of an insufficiently effective lavatory treatment composition which is released and retained within the sump of the toilet bowl. Such is particularly true wherein a sanitizing benefit is intended to be provided to the toilet bowl.

It is to be appreciated that during its operation, the interior volume of the device, that is to say the total interior volume of the inlet, hollow cavity, and outlet are not sufficiently sealed so to be pressurized by the flow of water being provided by the overflow conduit. Rather, both the force of gravity, as well as the dynamic flow force of the liquid, water, or the motive forces in the directional flow of the liquid being supplied to the device is essentially in a downward direction. Thus, the device does not require pressure-tight seals or pressure-tight connections in order to ensure its reliable operation, such as might be required if the flow of water from the overflow conduit were to be used to provide a pressurized, upward flow through the device. Furthermore, as the device is essentially unpressurized and as the connection between the outlet of the overflow conduit and the inlet to the lavatory treatment device taught herein are not via a pressure tight seal or pressure tight connection or fitting, should any unexpected and undesirable blockage or failure of the lavatory treatment device occur, such as by a blockage which would interrupt flow between the inlet and the outlet of the lavatory treatment device, then water exiting the overflow conduit would merely flow and overflow the inlet to the lavatory treatment device and into the cistern. Such provides a "fail-save" mode of operation. Such is particularly advantageous as, according to preferred embodiments, the open end of the inlet of the lavatory treatment devices talk herein are above the maximum water level of water contained within the cistern and, are generally at least 1 centimeter, preferably at least 2 cm, still more preferably at least about 3 cm above the open end of the overflow tube.

In further embodiments of the invention, the hollow cavity may contain two or more different chemical treatment composition's having different chemistries contained therein. In such embodiments, the hollow cavity may be divided by one or more for a cool walls or other dividing means which may divide at least a portion of the interior of the lavatory dispensing device into two or more parts coming each part which defines a volume which can contain a quantity of static water as well as a chemical treatment composition. The interior arrangement of such a lavatory treatment device having a divided hollow cavity may be such that fluid, e.g. water, enters into the interior of the lavatory treatment device via the inlet is directed towards one but not both of the divided parts, viz, a first part, and only the overflow volume of treatment composition exiting said first part sequentially or serially passes to the next part of the lavatory treatment device before exiting the device via the outlet. Alternately, the interior arrangement of such a lavatory treatment device having a divided hollow cavity may be such that fluid, viz., water, enters into the interior of the lavatory treatment device via the inlet and the volume of water entering the inlet is split or divided so that a part of the water flows to each of the divided parts of the hollow cavity of the lavatory dispensing device, and in a parallel fashion, contacts the separate chemical treatment compositions contained in each of the two or more divided parts of the hollow cavity, and does forms separate parallel lavatory treatment compositions which are only intermixed and come into contact with one another as they exit the hollow cavity and enter into the outlet part of the lavatory treatment device. Such an embodiment may be particularly advantageously used wherein is desire to form a lavatory treatment composition from a first part and the second part, which are namely a first lavatory treatment composition and a second lavatory treatment composition which react or interact to provide a technical benefit, score a visual benefit such as effervescence, foaming, a color change, and the like only upon the mixing of the first part, or more specifically a first composition formed by contacting water with a first chemical treatment composition, and the second part, or more specifically a second composition formed by contacting water with a second chemical treatment composition which are present, but separated from one another, within the hollow cavity of the lavatory dispensing device.

The lavatory dispensing device whether formed from a single unitary piece or assembled from a plurality of discrete pieces or elements may be formed from any of a variety of materials which can be used for the purpose described herein. Exemplary and preferred materials include metals such as coated papers which are at least for a time essentially impervious to water, metal sheets or metal foils, non-metallic materials any of a number of thermosettable or thermoformable synthetic polymers such as are widely used in casting or injection molding. Exemplary synthetic polymers such as polyamides, polyolefins (e.g., polypropylene, polyethylene) as well as polyalkyleneterephalates (i.e., polyethylene terephthalate, polybutylene terephthalate), polystyrenes, polysulfones, polycarbonates as well as copolymers formed from monomers of one or more of the foregoing being several nonlimiting examples of useful synthetic polymers. Preferably the material of construction is at least somewhat flexible. As to the material of construction of the lavatory dispensing device, the only criteria being that the selected materials used to fabricate device are not deleteriously affected by the chemical constituents of the chemical composition contained within device or the lavatory treatment compositions forums using the device, and that they are impervious to water. Is appreciated that is too more different materials of construction can be used to form the to retrieve and devices according to the invention.

The dispensing devices according to the invention necessarily also comprise a chemical treatment composition comprising at least one or more chemical constituents such that when the chemical treatment composition is rinsed or washed with water, one or more chemical compounds or chemical constituents are eluted from the solid block and dispersed or dissolved into said water and thereby forms a treatment composition which is useful in treating a sanitary appliance, particularly a toilet bowl. The treatment composition advantageously provides a cleaning and/or sanitizing benefit to the treated sanitary appliance.

The chemical treatment composition of the invention may include any known art cleaning agents or cleaning constituents known to those of ordinary skill in the relevant art, and without limitation include one or more detersive surfactants selected from anionic, cationic, nonionic as well as amphoteric or zwitterionic surfactants. Certain detersive surfactants may also provide a dual role in providing detergency as well as a disinfecting effect, viz, certain cationic surfactants, which are described hereinafter as a disinfecting agent. These one or more cleaning agents or cleaning constituents may be used with or without other constituents being present in the chemical treatment compositions of the invention.

In certain embodiments, the chemical treatment composition of the invention desirably comprises a surfactant constituent which may be one or more detersive surfactants.

Exemplary useful anionic surfactants which may be used in the chemical treatment composition of the invention can be broadly described as the water-soluble salts, particularly the alkali metal salts, of organic sulfuric acid reaction products having in their molecular structure an alkyl or alkaryl radical containing from about 8 to about 22 carbon atoms and a radical selected from the group consisting of sulfonic acid and sulfuric acid ester radicals. (Included in the term alkyl is the alkyl portion of higher acyl radicals). Important examples of the anionic surfactants which can be employed in practicing the present invention are the sodium or potassium alkyl sulfates, especially those obtained by sulfating the higher alcohols ($C_8$-$C_{18}$ carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); paraffin sulfonate surfactants having the general formula $RSO_3$ M, wherein R is a primary or secondary alkyl group containing from about 8 to about 22 carbon atoms (preferably 10 to 18 carbon atoms) and M is an alkali metal, e.g., sodium, lithium or potassium; sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid esters of the reaction product of one mole of a higher fatty alcohol (e.g., tallow or coconut oil alcohols) and about 1 to 10 moles of ethylene oxide; sodium or potassium salts of alkyl phenol ethylene oxide ether sulfates with about 1 to about 10 units of ethylene oxide per molecule and in which the alkyl radicals contain from about 8 to about 12 carbon atoms; the reaction products of fatty acids esterified with isethionic acid and neutralized with sodium hydroxide where, for example, the fatty acids are derived from coconut oil; sodium or potassium salts of fatty acid amides of a methyl tauride in which the fatty acids, for example, are derived from coconut oil and sodium or potassium β-acetoxy- or β-acetamido-alkanesulfonates where the alkane has from 8 to 22 carbon atoms.

Further examples of useful anionic surfactants are alpha olefin sulfonates, as well as salts thereof, e.g., alkali metal salts. Preferred are $C_8$ through $C_{22}$ alpha olefin sulfonates, particularly $C_{12}$ through $C_{18}$, and especially $C_{14}$, and $C_{16}$ alpha olefin sulfonates as well as blends of two or more thereof.

The detersive surfactant constituent of the chemical treatment composition of the invention may include one or more nonionic surfactants. Practically any hydrophobic compound having a carboxy, amido, or amino group with a free hydrogen attached to the nitrogen can be condensed with an alkylene oxide, especially ethylene oxide or with the polyhydration product thereof, a polyalkylene glycol, especially polyethylene glycol, to form a water soluble or water dispersible nonionic surfactant compound. Further, the length of the polyethenoxy hydrophobic and hydrophilic elements may various. Exemplary nonionic compounds include the polyoxyethylene ethers of alkyl aromatic compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

One class of useful nonionic surfactants include polyalkylene oxide condensates of alkyl phenols. These compounds include the condensation products of alkyl phenols having an alkyl group containing from about 6 to 12 carbon atoms in either a straight chain or branched chain configuration with an alkylene oxide, especially an ethylene oxide, the ethylene oxide being present in an amount equal to 5 to 25 moles of ethylene oxide per mole of alkyl phenol. Examples of compounds of this type include nonyl phenol condensed with about 9.5 moles of ethylene oxide per mole of nonyl phenol; dodecylphenol condensed with about 12 moles of ethylene oxide per mole of phenol; dinonyl phenol condensed with about 15 moles of ethylene oxide per mole of phenol and diisooctyl phenol condensed with about 15 moles of ethylene oxide per mole of phenol.

A further class of useful nonionic surfactants include the condensation products of aliphatic alcohols with from about 1 to about 60 moles of an alkylene oxide, especially an ethylene oxide. The alkyl chain of the aliphatic alcohol can either be straight or branched, primary or secondary, and generally contains from about 8 to about 22 carbon atoms. Examples of such ethoxylated alcohols include the condensation product of myristyl alcohol condensed with about 10 moles of ethylene oxide per mole of alcohol and the condensation product of about 9 moles of ethylene oxide with coconut alcohol (a mixture of fatty alcohols with alkyl chains varying in length from about 10 to 14 carbon atoms). Other examples are those $C_6$-$C_{11}$ straight-chain alcohols which are ethoxylated with from about 3 to about 6 moles of ethylene oxide. Their derivation is well known in the art. Examples include Alfonic® 810-4.5, which is described in product literature from Sasol as a $C_8$-$C_{10}$ straight-chain alcohol having an average molecular weight of 356, an ethylene oxide content of about 4.85 moles (about 60 wt. %), and an HLB of about 12; Alfonic® 810-2, which is described in product literature as a $C_8$-$C_{10}$ straight-chain alcohols having an average molecular weight of 242, an ethylene oxide content of about 2.1 moles (about 40 wt. %), and an HLB of about 12; and Alfonic® 610-3.5, which is described in product literature as having an average molecular weight of 276, an ethylene oxide content of about 3.1 moles (about 50 wt. %), and an HLB of 10. Other examples of alcohol ethoxylates are $C_{10}$ oxo-alcohol ethoxylates available from BASF under the Lutensol® ON tradename. They are available in grades containing from about 3 to about 11 moles of ethylene oxide (available under the names Lutensol® ON 30; Lutensol® ON 50; Lutensol® ON 60; Lutensol® ON 65; Lutensol® ON 66; Lutensol® ON 70; Lutensol® ON 80; and Lutensol® ON 110). Other examples of ethoxylated alcohols include the Neodol® 91 series non-ionic surfactants available from Shell Chemical Company which are described as $C_9$-$C_{11}$ ethoxylated alcohols. The Neodol® 91 series non-ionic surfactants of interest include Neodol® 91-2.5, Neodol® 91-6, and Neodol® 91-8. Neodol® 91-2.5 has been described as having about 2.5 ethoxy groups per molecule; Neodol 91-6 has been described as having about 6 ethoxy groups per molecule; and Neodol 91-8 has been described as having about 8 ethoxy groups per molecule. Further examples of ethoxylated alcohols include the Rhodasurf® DA series non-ionic surfactants available from Rhodia which are described to be branched isodecyl alcohol ethoxylates. Rhodasurf® DA-530 has been described as having 4 moles of ethoxylation and an HLB of 10.5; Rhodasurf® DA-630 has been described as having 6 moles of ethoxylation with an HLB of 12.5; and Rhodasurf® DA-639 is a 90% solution of DA-630. Further examples of ethoxylated alcohols include those from Tomah Products (Milton, Wis.) under the Tomadol® tradename with the formula $RO(CH_2CH_2O)_nH$ where R is the primary linear alcohol and n is the total number of moles of ethylene oxide. The ethoxylated alcohol series from Tomah include 91-2.5; 91-6; 91-8—where R is linear $C_9/C_{10}/C_{11}$ and n is 2.5, 6, or 8; 1-3; 1-5; 1-7; 1-73B; 1-9; where R is linear $C_{11}$ and n is 3, 5, 7 or 9; 23-1; 23-3; 23-5; 23-6.5—where R is linear $C_{12}/C_{13}$ and n is 1, 3, 5, or 6.5; 25-3; 25-7; 25-9; 25-12—where R is linear $C_{12}/C_{13}/C_{14}/C_{15}$ and n is 3, 7, 9, or 12; and 45-7; 45-13—where R is linear $C_{14}/C_{15}$ and n is 7 or 13.

A further class of useful nonionic surfactants include primary and secondary linear and branched alcohol ethoxylates, such as those based on $C_6$-$C_{18}$ alcohols which further include an average of from 2 to 80 moles of ethoxylation per mol of alcohol. These examples include the Genapol® UD (ex. Clariant, Muttenz, Switzerland) described under the tradenames Genapol® UD 030,$C_{11}$-oxo-alcohol polyglycol ether with 3 EO; Genapol® UD, 050 $C_{11}$-oxo-alcohol polyglycol ether with 5 EO; Genapol® UD 070, $C_{11}$-oxo-alcohol polyglycol ether with 7 EO; Genapol® UD 080, $C_{11}$-oxo-alcohol polyglycol ether with 8 EO; Genapol® UD 088, $C_{11}$-oxo-alcohol polyglycol ether with 8 EO; and Genapol® UD 110, $C_{11}$-oxo-alcohol polyglycol ether with 11 EO.

Exemplary useful nonionic surfactants include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of Tergitol® such as Tergitol 15-S-12 which is described as being $C_{11}$-$C_{15}$ secondary alkanol condensed with 9 ethylene oxide units, or Tergitol 15-S-9 which is described as being $C_{11}$-$C_{15}$ secondary alkanol condensed with 12 ethylene oxide units per molecule.

A further class of useful nonionic surfactants include those surfactants having a formula:

$$RO(CH_2CH_2O)_nH$$

wherein;

R is a mixture of linear, even carbon-number hydrocarbon chains ranging from $C_{12}H_{25}$ to $C_{16}H_{33}$ and n represents the number of ethoxy repeating units and is a number of from about 1 to about 12.

Surfactants of this formula are presently marketed under the Genapol® tradename (ex. Clariant), which surfactants include the "26-L" series of the general formula $RO(CH_2CH_2O)_nH$ wherein R is a mixture of linear, even carbon-number hydrocarbon chains ranging from $C_{12}H_{25}$ to $C_{16}H_{33}$ and n represents the number of repeating units and is a number of from 1 to about 12, such as 26-L-1,26-L-1.6, 26-L-2,26-L-3,26-L-5,26-L-45, 26-L-50, 26-L-60, 26-L-60N, 26-L-75, 26-L-80, 26-L-98N, and the 24-L series, derived from synthetic sources and typically contain about 55% $C_{12}$ and 45% $C_{1-4}$ alcohols, such as 24-L-3,24-L-45, 24-L-50, 24-L-60, 24-L-60N, 24-L-75, 24-L-92, and 24-L-98N, all sold under the Genapol® tradename.

Further useful non-ionic surfactants which may be used in the chemical treatment compositions include those presently marketed under the trade name Pluronics® (ex. BASF). The compounds are formed by condensing ethylene oxide with a hydrophobic base formed by the condensation of propylene oxide with propylene glycol. The molecular weight of the hydrophobic portion of the molecule is of the order of 950 to 4,000 and preferably 200 to 2,500. The addition of polyoxyethylene radicals of the hydrophobic portion tends to increase the solubility of the molecule as a whole so as to make the surfactant water-soluble. The molecular weight of the block polymers varies from 1,000 to 15,000 and the polyethylene oxide content may comprise 20% to 80% by weight. Preferably, these surfactants are in liquid form and particularly satisfactory surfactants are available as those marketed as Pluronics® L62 and Pluronics® L64.

Further nonionic surfactants which may be included in the inventive compositions include alkoxylated alkanolamides, preferably $C_8$-$C_{24}$ alkyl di($C_2$-$C_3$ alkanol amides), as represented by the following formula:

$$R_5—CO—NH—R_6—OH$$

wherein $R_5$ is a branched or straight chain $C_8$-$C_{24}$ alkyl radical, preferably a $C_{10}$-$C_{16}$ alkyl radical and more preferably a $C_{12}$-$C_{14}$ alkyl radical, and $R_6$ is a $C_1$-$C_4$ alkyl radical, preferably an ethyl radical.

According to certain particularly preferred embodiments the detersive surfactant constituent necessarily comprises a nonionic surfactant based on a linear primary alcohol particularly wherein the alkyl portion is a $C_8$ to $C_{16}$, but particularly a $C_9$ to $C_{11}$ alkyl group, and having an average of between about 6 to about 8 moles of ethoxylation.

One further useful class of nonionic surfactants include those in which the major portion of the molecule is made up of block polymeric $C_2$-$C_4$ alkylene oxides, with alkylene oxide blocks containing $C_3$ to $C_4$ alkylene oxides. Such nonionic surfactants, while preferably built up from an alkylene oxide chain starting group, can have as a starting nucleus almost any active hydrogen containing group including, without limitation, amides, phenols, and secondary alcohols.

One group of nonionic surfactants containing the characteristic alkylene oxide blocks are those which may be generally represented by the formula (A):

$$HO\text{-}(EO)_x(PO)_y(EO)_z\text{-}H \quad (A)$$

where EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R\text{-}(EO,PO)_a(EO,PO)_b\text{-}H \quad (B)$$

wherein R is an alkyl, aryl or aralkyl group, the alkoxy group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000-5000.

Still further useful nonionic surfactants containing polymeric butoxy (BO) groups can be represented by formula I as follows:

$$RO\text{-}(BO)_n(EO)_x\text{-}H \quad (C)$$

wherein R is an alkyl group containing 1 to 20 carbon atoms, n is about 15 and x is about 15.

Also useful as the nonionic block copolymer surfactants which also include polymeric butoxy groups are those which may be represented by the following formula (D):

$$HO\text{-}(EO)_x(BO)_n(EO)_y\text{-}H \quad (D)$$

wherein n is about 15, x is about 15 and y is about 15.

Still further useful nonionic block copolymer surfactants include ethoxylated derivatives of propoxylated ethylene diamine, which may be represented by the following formula:

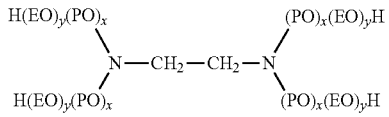

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Further useful nonionic surfactants include nonionic amine oxide constituent. Exemplary amine oxides include:

A) Alkyl di (lower alkyl) amine oxides in which the alkyl group has about 10-20, and preferably 12-16 carbon atoms, and can be straight or branched chain, saturated or unsaturated. The lower alkyl groups include between 1 and 7 carbon atoms. Examples include lauryl dimethyl amine oxide, myristyl dimethyl amine oxide, and those in which the alkyl group is a mixture of different amine oxide, dimethyl cocoamine oxide, dimethyl (hydrogenated tallow) amine oxide, and myristyl/palmityl dimethyl amine oxide;

B) Alkyl di (ehydrat lower alkyl) amine oxides in which the alkyl group has about 10-20, and preferably 12-16 carbon atoms, and can be straight or branched chain, saturated or unsaturated. Examples are bis(2-hydroxyethyl) cocoamine oxide, bis(2-hydroxyethyl) tallowamine oxide; and bis(2-hydroxyethyl) stearylamine oxide;

C) Alkylamidopropyl di(lower alkyl) amine oxides in which the alkyl group has about 10-20, and preferably 12-16 carbon atoms, and can be straight or branched chain, saturated or unsaturated. Examples are cocoamidopropyl dimethyl amine oxide and tallowamidopropyl dimethyl amine oxide; and D) Alkylmorpholine oxides in which the alkyl group has about 10-20, and preferably 12-16 carbon atoms, and can be straight or branched chain, saturated or unsaturated.

Preferably the amine oxide constituent is an alkyl di (lower alkyl) amine oxide as denoted above and which may be represented by the following structure:

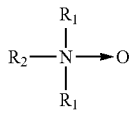

wherein each:

$R_1$ is a straight chained $C_1$-$C_4$ alkyl group, preferably both $R_1$ are methyl groups; and, $R_2$ is a straight chained $C_8$-$C_{18}$ alkyl group, preferably is $C_{10}$-$C_{14}$ alkyl group, most preferably is a $C_{1-2}$ alkyl group. Each of the alkyl groups may be linear or branched, but most preferably are linear. Most preferably the amine oxide constituent is lauryl dimethyl amine oxide. Technical grade mixtures of two or more amine oxides may be used, wherein amine oxides of varying chains of the $R_2$ group are present. Preferably, the amine oxides used in the present invention include $R_2$ groups which comprise at least 50% wt., preferably at least 60% wt. of $C_{1-2}$ alkyl groups and at least 25% wt. of $C_{1-4}$ alkyl groups, with not more than 15% wt. of $C_{16}$, $C_{18}$ or higher alkyl groups as the $R_2$ group.

Still further exemplary useful nonionic surfactants which may be used include certain alkanolamides including monoethanolamides and diethanolamides, particularly fatty monoalkanolamides and fatty dialkanolamides.

A cationic surfactant may be incorporated as a germicide or as a detersive surfactant in the chemical treatment composition of the present invention, particularly wherein a bleach constituent is absent from the chemical treatment composition. Cationic surfactants are per se, well known, and exemplary useful cationic surfactants may be one or more of those described for example in *McCutcheon's Functional Materials*, Vol. 2, 1998; *Kirk-Othmer, Encyclopedia of Chemical Technology*, 4th Ed., Vol. 23, pp. 481-541 (1997), the contents of which are herein incorporated by reference. These are also described in the respective product specifications and literature available from the suppliers of these cationic surfactants.

Examples of preferred cationic surfactant compositions useful in the practice of the instant invention are those which provide a germicidal effect to the concentrate compositions, and especially preferred are quaternary ammonium compounds and salts thereof, which may be characterized by the general structural formula:

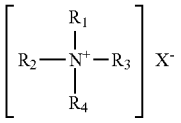

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex.

Exemplary quaternary ammonium salts within the above description include the alkyl ammonium halides such as cetyl trimethyl ammonium bromide, alkyl aryl ammonium halides such as octadecyl dimethyl benzyl ammonium bromide, N-alkyl pyridinium halides such as N-cetyl pyridinium bromide, and the like. Other suitable types of quaternary ammonium salts include those in which the molecule contains either amide, ether or ester linkages such as octyl phenoxy ethoxy ethyl dimethyl benzyl ammonium chloride, N-(laurylcocoaminoformylmethyl)-pyridinium chloride, and the like. Other very effective types of quaternary ammonium compounds which are useful as germicides include those in which the hydrophobic radical is characterized by a substituted aromatic nucleus as in the case of lauryloxyphenyltrimethyl ammonium chloride, cetylaminophenyltrimethyl ammonium methosulfate, dodecylphenyltrimethyl ammonium methosulfate, dodecylbenzyltrimethyl ammonium chloride, chlorinated dodecylbenzyltrimethyl ammonium chloride, and the like.

Preferred quaternary ammonium compounds which act as germicides and which are be found useful in the practice of the present invention include those which have the structural formula:

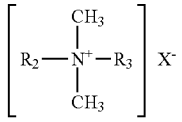

wherein $R_2$ and $R_3$ are the same or different $C_8$-$C_{12}$alkyl, or $R_2$ is $C_{12-16}$alkyl, $C_{8-18}$alkylethoxy, $C_{8-18}$alkylphenolethoxy and $R_3$ is benzyl, and X is a halide, for example chloride, bromide or iodide, or is a methosulfate anion. The alkyl groups recited in $R_2$ and $R_3$ may be straight-chained or branched, but are preferably substantially linear.

Particularly useful quaternary germicides include composicavity of the devicetions which include a single quaternary compound, as well as mixtures of two or more different quaternary compounds. Such useful quaternary compounds are available under the BARDAC®, BARQUAT®, HYAMINE®, LONZABAC®, and ONYXIDE® trademarks, which are more fully described in, for example, *McCutcheon's Functional Materials* (Vol. 2), North American Edition, 1998, as well as the respective product literature from the suppliers identified below. For example, BARDAC® 205M is described to be a liquid containing alkyl dimethyl benzyl ammonium chloride, octyl decyl dimethyl ammonium chloride; ehydra dimethyl ammonium chloride, and dioctyl dimethyl ammonium chloride (50% active) (also available as 80% active (BARDAC® 208M)); described generally in *McCutcheon's* as a combination of alkyl dimethyl benzyl ammonium chloride and dialkyl dimethyl ammonium chloride); BARDAC® 2050 is described to be a combination of octyl decyl dimethyl ammonium chloride/ehydra dimethyl ammonium chloride, and dioctyl dimethyl ammonium chloride (50% active) (also available as 80% active (BARDAC® 2080)); BARDAC® 2250 is described to be ehydra dimethyl ammonium chloride (50% active); BARDAC® LF (or BARDAC® LF-80), described as being based on dioctyl dimethyl ammonium chloride (BARQUAT® MB-50, MX-50, OJ-50 (each 50% liquid) and MB-80 or MX-80 (each 80% liquid) are each described as an alkyl dimethyl benzyl ammonium chloride; BARDAC® 4250 and BARQUAT® 4250Z (each 50% active) or BARQUAT® 4280 and BARQUAT 4280Z (each 80% active) are each described as alkyl dimethyl benzyl ammonium chloride/alkyl dimethyl ethyl benzyl ammonium chloride. Also, HYAMINE® 1622, described as diisobutyl phenoxy ethoxy ethyl dimethyl benzyl ammonium chloride (50% solution); HYAMINE® 3500 (50% actives), described as alkyl dimethyl benzyl ammonium chloride (also available as 80% active (HYAMINE® 3500-80)); and HYMAINE® 2389 described as being based on methyldodecylbenzyl ammonium chloride and/or methyldodecylxylene-bis-trimethyl ammonium chloride. (BARDAC®, BARQUAT® and HYAMINE® are presently commercially available from Lonza, Inc., Fairlawn, N.J.). BTC® 50 NF (or BTC® 65 NF) is described to be alkyl dimethyl benzyl ammonium chloride (50% active); BTC® 99 is described as ehydra dimethyl ammonium chloride (50% active); BTC® 776 is described to be myrisalkonium chloride (50% active); BTC® 818 is desc-chemical treatment compositions can take any of a variety of forms. In one preferred form, the chemical treatment compositions are compressed solid block compositions which are inserted into, or provided into the interior of the hollowribed as being octyl decyl dimethyl ammonium chloride, ehydra dimethyl ammonium chloride, and dioctyl dimethyl ammonium chloride (50% active) (available also as 80% active (BTC® 818-80%)); BTC® 824 and BTC® 835 are each described as being of alkyl dimethyl benzyl ammonium chloride (each 50% active); BTC® 885 is described as a combination of BTC® 835 and BTC® 818 (50% active) (available also as 80% active (BTC® 888)); BTC® 1010 is described as decahydra dimethyl ammonium chloride (50% active) (also available as 80% active (BTC® 1010-80)); BTC® 2125 (or BTC® 2125 M) is described as alkyl dimethyl benzyl ammonium chloride and alkyl dimethyl ethylbenzyl ammonium chloride (each 50% active) (also available as 80% active (BTC® 2125 80 or BTC® 2125 M)); BTC® 2565 is described as alkyl dimethyl benzyl ammonium chlorides (50% active) (also available as 80% active (BTC® 2568)); BTC® 8248 (or BTC® 8358) is described as alkyl dimethyl benzyl ammonium chloride (80% active) (also available as 90% active (BTC® 8249)); ONYXIDE® 3300 is described as n-alkyl dimethyl benzyl ammonium saccharinate (95% active). (BTC® and ONYXIDE® are presently commercially available from Stepan Company, Northfield, Ill.) Polymeric quaternary ammonium salts based on these monomeric structures are also considered desirable for the present invention. One example is POLYQUAT®, described as being a 2-butenyldimethyl ammonium chloride polymer.

Preferred quaternary germicides used in the chemical treatment compositions are those which are supplied in a solid or powdered form, as such greatly facilitates the manufacture of the chemical treatment compositions.

When present in a chemical treatment composition, it is preferred that the germicidal cationic surfactant(s) are present in amounts so to dispense at least about 200 parts per million (ppm) in the water flushed into the sanitary appliance, e.g., toilet bowl, or into the water retained in the sanitary appliance at the conclusion of the flush cycle.

Further detersive surfactants which may be included in the chemical treatment compositions are amphoteric and zwitterionic surfactants which provide a detersive effect. Exemplary useful amphoteric surfactants include alkylbetaines, particularly those which may be represented by the following structural formula:

$$RN^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. Further exemplary useful amphoteric surfactants include amidoalkylbetaines, such as amidopropylbetaines which may be represented by the following structural formula:

$$RCONHCH_2CH_2CH_2N^{+}(CH_3)_2CH_2COO^{-}$$

wherein R is a straight or branched hydrocarbon chain which may include an aryl moiety, but is preferably a straight hydrocarbon chain containing from about 6 to 30 carbon atoms. When present, such one or more detersive surfactants may be present in any effective amount, and may comprise from 0.001% to 100% wt. of the chemical treatment composition.

Further exemplary chemical constituents may be one or more sanitizing agents or germicides which may be present with our without other constituents being present in the chemical treatment compositions of the lavatory dispensing devices.

The sanitizing agent can be any sanitizing composition known to those of ordinary skill in the relevant art, and without limitation exemplary sanitizing compositions include materials containing alkyl halohydantoins, alkali metal haloisocyanurates, bleach, essential oils, non-quaternary ammonium based germicidal compounds as well as quaternary ammonium germicidal compounds.

By way of non-limiting example is a bleach constituent. The bleach constituent is relatively inert in the dry state but, which on contact with water, releases oxygen, hypohalite or a halogen especially chlorine. Representative examples of typical oxygen-release bleaching agents, suitable for incorporation in the chemical treatment composition include the alkali metal perborates, e.g., sodium perborate, and alkali metal monopersulfates, e.g., sodium monopersulfates, potassium monopersulfate, alkali metal monoperphosphates, e.g., disodium monoperphosphate and dipotassium monoperphosphate, as well as other conventional bleaching agents capable of liberating hypohalite, e.g., hypochlorite and/or hypobromite, include heterocyclic N-bromo- and N-chloro-cyanurates such as trichloroisocyanuric and tribromoiscyanuric acid, dibromocyanuric acid, dichlorocyanuric acid, N-monobromo-N-mono-chlorocyanuric acid and N-monobromo-N, N-dichlorocyanuric acid, as well as the salts thereof with water solubilizing cations such as potassium and sodium, e.g., sodium N-monobromo-N-monochlorocyanurate, potassium dichlorocyanurate, sodium dichlorocyanurate, as well as other N-bromo and N-chloro-imides, such as N-brominated and N-chlorinated succinimide, malonimide, phthalimide and naphthalimide. Also useful in the chemical treatment composition as hypohalite-releasing bleaches are halohydantoins which may be used include those which may be represented by the general structure:

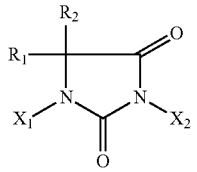

wherein:

$X_1$ and $X_2$ are independently hydrogen, chlorine or bromine; and, $R_1$ and $R_2$ are independently alkyl groups having from 1 to 6 carbon atoms.

Examples of halohydantoins include, for example, N,N'-dichloro-dimethyl-hydantoin, N-bromo-N-chloro-dimethyl-hydantoin, N,N'-dibromo-dimethyl-hydantoin, 1,4-dichloro, 5,5-dialkyl substituted hydantoin, wherein each alkyl group independently has 1 to 6 carbon atoms, N-monohalogenated hydantoins such as chlorodimethylhydantoin (MCDMH) and N-bromo-dimethylhydantoin (MBDMH); dihalogenated hydantoins such as dichlorodimethylhydantoin (DCDMH), dibromodimethylhydantoin (DBDMH), and 1-bromo-3-chloro-5,5,-dimethylhydantoin (BCDMH); and halogenated methylethylhydantoins such as chloromethylethylhydantion (MCMEH), dichloromethylethylhydantoin (DCMEH), bromomethylethylhydantoin (MBMEH), dibromomethylethylhydantoin (DBMEH), and bromochloromethylethylhydantoin (BCMEH), and mixtures thereof. Other suitable organic hypohalite liberating bleaching agents include halogenated melamines such as tribromomelamine and trichloromelamine. Suitable inorganic hypohalite-releasing bleaching agents include lithium and calcium hypochlorites and hypobromites. The various chlorine, bromine or hypohalite liberating agents may, if desired, be provided in the form of stable, solid complexes or hydrates, such as sodium p-toluene sulfobromamine trihydrate; sodium benzene sulfochloramine ehydrate; calcium hypobromite tetrahydrate; and calcium hypochlorite tetrahydrate. Brominated and chlorinated trisodium phosphates formed by the reaction of the corresponding sodium hypohalite solution with trisodium orthophosphate (and water, as necessary) likewise comprise useful inorganic bleaching agents for incorporation into the inventive chemical treatment composition and the treatment blocks formed therefrom.

When present, preferably the bleach constituent is a hypohalite liberating compound and more preferably is a hypohalite liberating compound in the form of a solid complex or hydrate thereof. Particularly preferred are chloroisocynanuric acids and alkali metal salts thereof, preferably potassium, and especially sodium salts thereof. Examples of such compounds include trichloroisocyananuric acid, dichloroisocyanuric acid, sodium dichloroisocyanurate, potassium dichloroisocyanurate, and trichloro-potassium dichloroisocynanurate complex. The most preferred chlorine bleach material is sodium dichloroisocyanurate; the ehydrate of this material being particularly preferred.

When present, the bleach constituent may be present in any effective amount and may comprise up to about 90% wt., preferably at least about 0.01-100% wt of the chemical treatment composition.

Other germicidally effective agents useful as sanitizing agents include sodium dichloroisocyanurate (DCCNa) and sodium dibromoisocyanurate. Further examples of non-quaternary ammonium based sanitizing agents include pyrithiones, dimethyldimethylol hydantoin, methylchloroisothiazolinone/methylisothiazolinone sodium sulfite, sodium bisulfite, imidazolidinyl urea, diazolidinyl urea, benzyl alcohol, 2-bromo-2-nitropropane-1,3-diol, formalin (formaldehyde), iodopropenyl butylcarbamate, chloroacetamide, methanamine, methyldibromonitrile glutaronitrile, glutaraldehyde, 5-bromo-5-nitro-1,3-dioxane, phenethyl alcohol, o-phenylphenol/sodium o-phenylphenol, sodium hydroxymethylglycinate, polymethoxy bicyclic oxazolidine, dimethoxane, thimersal dichlorobenzyl alcohol, captan, chlorphenenesin, dichlorophene, chlorbutanol, glyceryl laurate, halogenated diphenyl ethers, phenolic compounds, mono- and poly-alkyl and aromatic halophenols, resorcinol and its derivatives, bisphenolic compounds, benzoic esters (parabens), halogenated carbanilides, 3-trifluoromethyl-4,4'-dichlorocarbanilide, and 3,3',4-trichlorocarbanilide. More preferably, the non-cationic antimicrobial agent is a mono- and poly-alkyl and aromatic halophenol selected from the group p-chlorophenol, methyl p-chlorophenol, ethyl p-chlorophenol, n-propyl p-chlorophenol, n-butyl p-chlorophenol, n-amyl p-chlorophenol, sec-amyl p-chlorophenol, n-hexyl p-chlorophenol, cyclohexyl p-chlorophenol, n-heptyl p-chlorophenol, n-octyl p-chlorophenol, o-chlorophenol, methyl o-chlorophenol, ethyl o-chlorophenol, n-propyl o-chlorophenol, n-butyl o-chlorophenol, n-amyl o-chlorophenol, tert-amyl o-chlorophenol, n-hexyl o-chlorophenol, n-heptyl o-chlorophenol, o-benzyl p-chlorophenol, o-benzyl-m-methyl p-chlorophenol, o-benzyl-m, m-dimethyl p-chlorophenol, o-phenylethyl p-chlorophenol, o-phenylethyl-m-methyl p-chlorophenol, 3-methyl p-chlorophenol, 3,5-dimethyl p-chlorophenol, 6-ethyl-3-methyl p-chlorophenol, 6-n-propyl-3-methyl p-chlorophenol, 6-iso-propyl-3-methyl p-chlorophenol, 2-ethyl-3,5-dimethyl p-chlorophenol, 6-sec-butyl-3-methyl p-chlorophenol, 2-iso-propyl-3,5-dimethyl p-chlorophenol, 6-diethylmethyl-3-methyl p-chlorophenol, 6-iso-propyl-2-ethyl-3-methyl p-chlorophenol, 2-sec-amyl-3,5-dimethyl p-chlorophenol 2-diethylmethyl-3,5-dimethyl p-chlorophenol, 6-sec-octyl-3-methyl p-chlorophenol, p-chloro-m-cresol, p-bromophenol, methyl p-bromophenol, ethyl p-bromophenol, n-propyl p-bromophenol, n-butyl p-bromophenol, n-amyl p-bromophenol, sec-amyl p-bromophenol, n-hexyl p-bromophenol, cyclohexyl p-bromophenol, o-bromophenol, tert-amyl o-bromophenol, n-hexyl o-bromophenol, n-propyl-m,m-dimethyl o-bromophenol, 2-phenyl phenol, 4-chloro-2-methyl phenol, 4-chloro-3-methyl phenol, 4-chloro-3,5-dimethyl phenol, 2,4-dichloro-3,5-dimethylphenol, 3,4,5,6-terabromo-2-methylphenol, 5-methyl-2-pentylphenol, 4-isopropyl-3-methylphenol, para-chloro-meta-xylenol, dichloro meta xylenol, chlorothymol, and 5-chloro-2-hydroxydiphenylmethane.

Quaternary ammonium based sanitizing agents include any cationic surfactant which is known or may be found to provide a broad antibacterial or sanitizing function; these have been described above with reference to detersive surfactants.

As a further chemical constituent, the chemical treatment compositions of the invention may also comprise a coloring agent which imparts either a color to chemical treatment compositions and/or to the water in which it comes into contact, but especially which imparts color to the water contained within the sanitary appliance. Where the sanitary appliance is a toilet, desirably the coloring agent imparts a color to the water contained within the toilet bowl particularly following the flush cycle of a toilet. Such coloring agents have great consumer appeal, and indeed any known art coloring agent may be provided in any effective amount in order to impart a coloring effect. Colorants, especially dyes, are preferred when formulated as dry powders to enable direct incorporation into chemical treatment compositions of the invention, however, liquid colorants may be employed in conjunction with suitable carriers. Useful colorants include any materials which may provide a desired coloring effect. Exemplarly useful coloring agents include dyes, e.g., Alizarine Light Blue B (C.I. 63010), Carta Blue VP (C.I. 24401), Acid Green 2G (C.I. 42085), Astragon Green D (C.I. 42040) Supranol Cyanine 7B (C.I. 42675), Maxilon Blue 3RL (C.I. Basic Blue 80), acid yellow 23, acid violet 17, a direct violet dye (Direct violet 51), Drimarine Blue Z-RL (C.I. Reactive Blue 18), Alizarine Light Blue H-RL (C.I. Acid Blue 182), FD&C Blue No. 1, FD&C Green No. 3 and Acid Blue No. 9. When a bleach constituent is included in the chemical treatment composition, the colorant, e.g., dye, should be selected so to ensure the compatibility of the colorant with the bleach constituent, or so that its color persists despite the presence in the toilet bowl of a concentration of hypochlorite which is effective to maintain sanitary conditions. Frequently however, a chemical treatment composition which includes a bleach constituent do not comprise any colorants. Desirably the colorants, when present, do not exceed 15% wt. of the chemical treatment composition, although generally lesser amounts are usually effective. When present, colorants are desirably present in an amount from about 0.1 to 15 percent of the total weight of the chemical treatment composition.

The inventors have also surprisingly discovered that the surface appearance of the chemical treatment composition may be significantly improved wherein there is included in the chemical treatment composition an amount of titanium dioxide. The titanium dioxide included in amounts which are observed to be effective in improving the visible surface appearance following ageing or use of the block in a sanitary appliance, especially following contact with and erosion by water such as flush water of a sanitary appliance. The presence of the titanium dioxide has been observed to minimize or to eliminate the unattractive spotted, streaked, or otherwise unattractive surface appearance of similar blocks, but which exclude titanium dioxide among their constituents. When present, titanium dioxide is desirably present in an amount from about 0.01 to 15 percent of the total weight of the chemical treatment composition.

The chemical treatment compositions may include a fragrance or other air treatment constituent. The fragrance may be any composition which is known to the art to provide a perceptible fragrancing benefit, any may be based on naturally occurring materials such as one or more essential oils, or may be based on synthetically produced compounds as well. Examples of essential oils include pine oil, Anetlhole 20/21 natural, Aniseed oil china star, Aniseed oil globe brand, Balsam (Perui), Basil oil (India), Black pepper oil, Black pepper oleoresin 40/20, Bois de Rose (Brazil) FOB, Bomneol Flakes (China), Camphor oil, White, Camphor powder synthetic technical, Canaga oil (Java), Cardamom oil, Cassia oil (China), Cedarwood oil (China) BP, Cinnamon bark oil, Cinnamon leaf oil, Citronella oil, Clove bud oil, Clove leaf, Coriander (Russia), Counmarin 69° C. (China), Cyclamen Aldehyde, Diphenyl oxide, Ethyl ehydrat, Eucalyptol, Eucalyptus oil, Eucalyptus citriodora, Fennel oil, Geranium oil, Ginger oil, Ginger oleoresin (India), White grapefruit oil, Guaiacwood oil, Gurjun balsam, Heliotropin, Isobornyl acetate, Isolongifolene, Juniper berry oil, L-methyl acetate, Lavender oil, Lemon oil, Lemongrass oil, Lime oil distilled, Litsea Cubeba oil, Longifolene, Menthol crystals, Methyl cedryl ketone, Methyl chavicol, Methyl salicylate, Musk ambrette, Musk ketone, Musk xylol, Nutmeg oil, Orange oil, Patchouli oil, Peppermint oil, Phenyl ethyl alcohol, Pimento berry oil, Pimento leaf oil, Rosalin, Sandalwood oil, Sandenol, Sage oil, Clary sage, Sassafras oil, Spearmint oil, Spike lavender, Tagetes, Tea tree oil, Vanilin, Vetyver oil (Java), and Wintergreen oil.

Many of these essential oils function as a fragrance agent, which fragrance agent which may be a substance or mixture of various substances including those which are naturally derived (i.e., obtained by extraction of flower, herb, blossom or plant), those which are artificially derived or produced (i.e., mixture of natural oils and/or oil constituents), and those which are synthetically produced substances (odiferous substances). Generally fragrance agents are complex mixtures or blends various organic compounds including, but not limited to, certain alcohols, aldehydes, ethers, alamatic compounds and varying amounts of essential oils such as from about 0 to about 25% by weight, usually from about 0.05 to about 12% by weight, the essential oils themselves being volatile odiferous compounds and also functioning to aid in the dissolution of the other components of the fragrance agent. In the present invention, the precise composition of the fragrance agent desirably emanates a pleasing fragrance, but the nature of the fragrance agent is not critical to the success of the invention.

As noted above, in conjunction with or in the absence of a fragrance constituent, the chemical treatment compositions may comprise an air treatment constituent. Such may be any other material which is useful in providing treatment of ambient air, such as a sanitizing agents. e.g., one or more glycols or alcohols, or materials which are intended to counteract, neutralize, or mask odors in the absence of, or in conjunction with, the fragrance composition of the present invention. Alternatively, the air treatment constituent may be one or more materials which provide and effective insecticide repelling or insecticidal benefit; such would be particularly useful in climates or environments where insects present a nuisance or health hazard.

In certain embodiments of the invention, when present, such an air treatment composition and/or fragrance composition may be provided separately from the chemical treatment compositions. For example, such an air treatment composition and/or fragrance composition may be provided in a reservoir comprising a quantity of an air treatment composition and/or fragrance composition which may form part of or be used with the lavatory treatment device. Such a reservoir can take any shape or suitable form, and can be included within the interior of the device, or on the exterior of the device, or may be even be separate from the device but provided as a separate article or element which is separate or separable from the device but intended to be placed in the near proximity of the device, e.g. attached to another part of the toilet or lavatory appliance or nearby to the toilet or lavatory appliance. By way of nonlimiting examples, such a reservoir may include a porous material such as a pad or tablet which is impregnated with, or upon which is absorbed a volatile composition useful in providing an air treatment benefit, a gel or a solid composition which also contains a volatile air treatment composition which may emanate from the reservoir. Alternately the reservoir may contain a quantity of a particulate material in the form of a single body, e.g. plate, or as a plurality of spheres, or beads which function as a reservoir for an air treatment composition and/or fragrance composition, and from whence they may be delivered to the ambient environment. Non-limiting examples of such materials include those currently marketed under the tradename Auracell® (ex. Rotuba Extruders) which are based on fragranced cellulosic polymers, as well as PolyIFF® (ex. International Flavors and Fragrances Inc.), as well as Tenite® (ex. Eastman Chemical Co.).

As further chemical constituents, the chemical treatment compositions of the invention may comprise an anti-limescale agent, which can be generally classified as a cleaning agent in that it provides a cleaning effect to treated lavatory device surfaces. The anti-limescale agent can virtually any known anti-limescale agent compositions known to those of ordinary skill in the relevant art. For example, compositions containing anionic and/or nonionic surfactants together with typical anti-limescale agents, for example, amidosulfonic acid, bisulfate salts, organic acids, organic phosphoric salts, alkali metal polyphosphates, and the like. Examples of anti-limescale agent compositions can be found in, for example, U.S. Pat. Nos. 5,759,974; 4,460,490; and 4578207, the contents of which are herein incorporated by reference. Further examples of anti-limescale agents include organic acids (for example, citric acid, lactic acid, adipic acid, oxalic acid and the like), organic phosphoric salts, alkali metal polyphosphates, sulfonic, and sulfamic acids and their salts, bisulfate salts, EDTA, phosphonates, and the like.

The chemical treatment compositions may comprise stain inhibiting materials. The chemical treatment composition of the invention may, for example, include an effective amount of a manganese stain inhibiting agent which is advantageously included wherein the sanitary appliance is supplied by a water source having an appreciable or high amount of manganese. Such water containing a high manganese content are known to frequently deposit unsightly stains on surfaces of sanitary appliances, especially when the chemical treatment composition also contains a bleach source which provides a hypochlorite. To counteract such an effect the chemical treatment composition of the present invention may comprise a manganese stain inhibiting agent, such as a partially hydrolyzed polyacrylamide having a molecular weight of about 2000 to about 10,000, a polyacrylate with a molecular weight of about 2000 to about 10,000, and/or copolymers of ethylene and maleic acid anhydride with a molecular weight of from about 20,000 to about 100,000. When present the satin inhibiting materials may comprise to about 10% wt. of the weight of the chemical treatment composition.

The chemical treatment compositions of the invention may include one or more preservatives. Such preservatives are primarily included to reduce the growth of undesired microorganisms within the treatment blocks formed from the chemical treatment composition during storage prior to use or while used, although it is expected that the such a preservative may impart a beneficial antimicrobial effect to the water in the sanitary appliance to which the treatment block is provided. Exemplary useful preservatives include compositions which include parabens, including methyl parabens and ethyl parabens, glutaraldehyde, formaldehyde, 2-bromo-2-nitropropoane-1,3-diol, 5-chloro-2-methyl-4-isothiazolin-3-one, 2-methyl-4-isothiazoline-3-one, and mixtures thereof. One exemplary composition is a combination 5-chloro-2-methyl-4-isothiazolin-3-one and 2-methyl-4-isothiazolin-3-one where the amount of either component may be present in the mixture anywhere from 0.001 to 99.99 weight percent, based on the total amount of the preservative. For reasons of availability, the most preferred preservative are those commercially available preservative comprising a mixture of 5-chloro-2-methyl-4-isothiazolin-3-one and 2-methyl-4-isothiazolin-3-one marketed under the trademark KATHON® CG/ICP as a preservative composition presently commercially available from Rohm and Haas (Philadelphia, Pa.). Further useful preservative compositions include KATHON® CG/ICP II, a further preservative composition presently commercially available from Rohm and Haas (Philadelphia, Pa.), PROXEL® which is presently commercially available from Zeneca Biocides (Wilmington, Del.), SUTTOCIDE® A which is presently commercially available from Sutton Laboratories (Chatam, N.J.) as well as TEX-TAMER® 38AD which is presently commercially available from Calgon Corp. (Pittsburgh, Pa.). When present, the optional preservative constituent should not exceed about 5% wt. of the chemical treatment composition, although generally lesser amounts are usually effective.

The chemical treatment compositions may include a binder constituent. The binder may function in part controlling the rate of dissolution of the tablet. The binder constituent may be a clay, but preferably is a water-soluble or water-dispersible gel-forming organic polymer. The term "gel-forming" as applied to this polymer is intended to indicate that on dissolution or dispersion in water it first forms a gel which, upon dilution with further water, is dissolved or dispersed to form a free-flowing liquid. The organic polymer serves essentially as binder for the tablets produced in accordance with the invention although, as will be appreciated, certain of the polymers envisaged for use in accordance with the invention also have surface active properties and thereby serve not only as binders but also enhance the cleansing ability of the tablets of the invention. Further certain organic polymers, such as substituted celluloses, also serve as soil antiredeposition agents. A wide variety of water-soluble organic polymers are suitable for use in the chemical treatment composition of the present invention. Such polymers may be wholly synthetic or may be semi-synthetic organic polymers derived from natural materials. Thus, for example, on class of organic polymers for use in accordance with the invention are chemically modified celluloses such as ethyl cellulose, methyl cellulose, sodium carboxymethyl cellulose, hydroxypropyl cellulose, hydroxypropyl methyl cellulose, ethyl hydroxyethyl cellulose, carboxymethyl hydroxyethyl cellulose, and hydroxyethyl cellulose. Another class of organic polymers which may be used include naturally derived or manufactured (fermented) polymeric materials such as alginates and carageenan. Also, water-soluble starches and gelatin may be used as the optional binder constituent. The cellulose based binders are a preferred class of binders for use in the chemical treatment composition and may possess the property of inverse solubility that is their solubility decreases with increasing temperature, thereby rendering the tablets of the invention suitable for use in locations having a relatively high ambient temperature.

The optional binder constituent may also be one or more synthetic polymers e.g, polyvinyl alcohols; water-soluble partially hydrolyzed polyvinyl acetates; polyacrylonitriles; polyvinyl pyrrolidones; water-soluble polymers of ethylenically unsaturated carboxylic acids, such as acrylic acid and methacrylic acid, and salts thereof; base-hydrolysed starch-polyacrylonitrile copolymers; polyacrylamides; ethylene oxide polymers and copolymers; as well as carboxypolymethylenes.

The chemical treatment composition may optionally include one or more dissolution control agents. Such dissolution control agent are materials which provide a degree of hydrophobicity to the treatment block formed from the chemical treatment composition whose presence in the treatment block contributes to the slow uniform dissolution of the treatment block when contacted with water, and simultaneously the controlled release of the active constituents of the chemical treatment composition. Preferred for use as the dissolution control agents are mono- or di-alkanol amides derived from $C_8$-$C_{16}$ fatty acids, especially $C_{12}$-$C_{14}$ fatty acids having a $C_2$-$C_6$ monoamine or diamine moiety. When included the dissolution control agent may be included in any effective amount, but desirably the dissolution control agent is present in an amount not to exceed about 600% wt. of the chemical treatment composition, although generally lesser amounts are usually effective. Generally when present, the dissolution control agent is present from about 0.1% wt. to about 15% wt., based on the total weight of the chemical treatment compositions of which they form a part The chemical treatment compositions may optionally include one or more water-softening agents or one or more chelating agents, for example inorganic water-softening agents such as sodium hexametaphosphate or other alkali metal polyphosphates or organic water-softening agents such as ethylenediaminetetraacetic acid and nitrilotriacetic acid and alkali metal salts thereof. When present, such water-softening agents or chelating agents should not exceed about 50% wt. of the chemical treatment composition, although generally lesser amounts are usually effective.

The chemical treatment composition may optionally include one or more solid water-soluble acids or acid-release agents such as sulphamic acid, citric acid or sodium hydrogen sulphate. When present, such solid water-soluble acids or acid-release agents should not exceed about 50% wt. of the chemical treatment composition, although generally lesser amounts are usually effective.

The chemical treatment composition may include diluent materials may be included to provide additional bulk of the product chemical treatment composition and may enhance leaching out of the surfactant constituent when the chemical treatment composition is placed in water. Exemplary diluent materials include any soluble inorganic alkali, alkaline earth metal salt or hydrate thereof, for example, chlorides such as sodium chloride, magnesium chloride and the like, carbonates and bicarbonates such as sodium carbonate, sodium bicarbonate and the like, sulfates such as magnesium sulfate, copper sulfate, sodium sulfate, zinc sulfate and the like, borax, borates such as sodium borate and the like, as well as others known to the art but not particularly recited herein. Exemplary organic diluents include, inter alia, urea, as well as water soluble high molecular weight polyethylene glycol and polypropylene glycol. When present, such diluent materials should not exceed about 80% wt. of the chemical treatment composition, although generally lesser amounts are usually effective. Preferably a sulfate salt, e.g., magnesium sulfate, copper sulfate, sodium sulfate, zinc sulfate and the like, and particularly sodium sulfate is necessarily present in the chemical treatment composition and treatment blocks formed therefrom.

The chemical treatment composition and treatment blocks formed therefrom may include one or more fillers. Such fillers are typically particulate solid water-insoluble materials which may be based on inorganic materials such as talc or silica, particulate organic polymeric materials such as finely comminuted water insoluble synthetic polymers. When present, such fillers should not exceed about 50% wt. of the chemical treatment composition, although generally lesser amounts are usually effective.

The chemical treatment composition and treatment blocks formed therefrom may include one or more further processing aids. For example, the chemical treatment composition may also include other binding and/or plasticizing ingredients serving to assist in the manufacture thereof, for example, polypropylene glycol having a molecular weight from about 300 to about 10,000 in an amount up to about 20% by weight, preferably about 4% to about 15% by weight of the mixture may be used. The polypropylene glycol reduces the melt viscosity, acts as a demolding agent and also acts to plasticize the block when the composition is prepared by a casting process. Other suitable plasticizers such as pine oil fractions, d-limonene, dipentene and the ethylene oxide-propylene oxide block copolymers may be utilized. Other useful processing aids include tabletting lubricants such as metallic stearates, stearic acid, paraffin oils or waxes or sodium borate which facilitate in the formation of the treatment blocks in a tabletting press or die.

One advantageously utilized processing aid is a diester constituent which may be represented by the following structure:

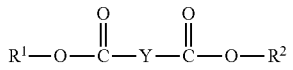

wherein:

$R^1$ and $R^2$ can independently be $C_1$-$C_6$ alkyl which may optionally substituted, Y is $(CH_2)_x$, wherein x is 0-10, but is preferably 1-8, and while Y may be a linear alkyl or phenyl moiety, desirably Y includes one or more oxygen atoms and/or is a branched moiety.

Exemplary diester constituents include the following diester compounds according to the foregoing structure: dimethyl oxalate, diethyl oxalate, diethyl oxalate, dipropyl oxalate, dibutyl oxalate, diisobutyl oxalate, dimethyl succinate, diethyl succinate, diethylhexyl succinate, dimethyl glutarate, diisostearyl glutarate, dimethyl adipate, diethyl adipate, diisopropyl adipate, dipropyl adipate, dibutyl adipate, diisobutyl adipate, dihexyladipate, di-$C_{12-15}$-alkyl adipate, dicapryl adipate, dicetyl adipate, diisodecyl adipate, diisocetyl adipate, diisononyl adipate, diheptylundecyl adipate, ditridecyl adipate, diisostearyl adipate, diethyl sebacate, diisopropyl sebacate, dibutyl sebacate, diethylhexylsebacate, diisocetyl dodecanedioate, dimethyl brassylate, dimethyl phthalate, diethyl phthalate, dibutyl phthalate.

Preferred diester constituents include those wherein Y is —$(CH_2)_x$— wherein x has a value of from 0-6, preferably a value of 0-5, more preferably a value of from 1-4, while $R^1$ and $R^2$ are $C_1$-$C_6$ alkyl groups which may be straight chained alkyl but preferably are branched, e.g, iso- and tert-moieties. Particularly preferred diester compounds are those in which the compounds terminate in ester groups.

A further advantageously utilized processing aid is a hydrocarbon solvent constituent. The hydrocarbon solvents are immiscible in water, may be linear or branched, saturated or unsaturated hydrocarbons having from about 6 to about 24 carbon atoms, preferably comprising from about 12 to about 16 carbon atoms. Saturated hydrocarbons are preferred, as are branched hydrocarbons. Such hydrocarbon solvents are typically available as technical grade mixtures of two or more specific solvent compounds, and are often petroleum distillates. Nonlimiting examples of some suitable linear hydrocarbons include decane, dodecane, decene, tridecene, and combinations thereof. Mineral oil is one particularly preferred form of a useful hydrocarbon solvent. Further preferred hydrocarbon solvents include paraffinic hydrocarbons including both linear and branched paraffinic hydrocarbons. The former are commercially available as NORPAR solvents (ex. ExxonMobil Corp.) while the latter are available as ISOPAR solvents (ex. ExxonMobil Corp.) Mixtures of branched hydrocarbons especially as isoparaffins form a further particularly preferred form of a useful hydrocarbon solvent of the invention. Particularly useful technical grade mixtures of isoparaffins include mixtures of isoparaffinic organic solvents having a relatively narrow boiling range. Examples of these commercially available isoparaffinic organic solvents include ISOPAR C described to be primarily a mixture of $C_7$-$C_8$ isoparaffins, ISOPAR E described to be primarily a mixture of $C_8$-$C_9$ isoparaffins, ISOPAR G described to be primarily a mixture of $C_{10}$-$C_{11}$ isoparaffins, ISOPAR H described to be primarily a mixture of $C_{11}$-$C_{12}$ isoparaffins, ISOPAR J, ISOPAR K described to be primarily a mixture of $C_{11}$-$C_{12}$ isoparaffins, ISOPAR L described to be primarily a mixture of $C_{11}$-$C_{13}$ isoparaffins, ISOPAR M described to be primarily a mixture of $C_{13}$-$C_{14}$ isoparaffins, ISOPAR P and ISOPAR V described to be primarily a mixture of $C_{12}$-$C_{20}$ isoparaffins.

When present, such further processing aids are typically included in amounts of up to about 50% by weight, preferably to 20% wt. of the chemical treatment composition, although generally lesser amounts are usually effective.

The chemical treatment compositions may be provided in any of a number of forms. In certain preferred embodiments the chemical treatment composition may be provided in the form of at tablet or cake which is formed by extrusion and/or tabletting of the chemical treatment composition into suitably sized tablets, cakes or blocks. In a further embodiment the chemical treatment compositions may be formed in situ within the devices of the invention, for example by providing a molten or flowable quantity of the chemical treatment composition to the hollow cavity of the device and permitting it to set or hard within the cavity, e.g. by cooling, where it forms a mass of the chemical treatment composition.

Ideally the chemical treatment composition exhibit a density greater than that of water which ensures that they will sink when suspended in a body of water, e.g., the water present within the hollow cavity.

While the mass of the chemical treatment compositions formed from the chemical treatment compositions may vary, and amount of up to an including 500 grams may be practiced, generally the mass of the chemical treatment compositions do not exceed about 250 grams. Advantageously the mass of the chemical treatment compositions is between about 50 and 150 grams. It is appreciated that chemical treatment compositions having great mass should provide a longer useful service life of the lavatory dispensing devices, with the converse being equally true.

The chemical treatment compositions according to the present invention may also be provided with a coating of a water-soluble film, such as polyvinyl acetate following the formation of the treatment blocks from the recited chemical treatment composition. Such may be desired for improved handling, however such is often unnecessary as preferred embodiments of the blocks exhibit a lower likelihood of sticking to one another following manufacture than many prior art treatment block compositions.

It will be appreciated by those of ordinary skill in the art that several of the components which are directed to provide a chemical composition can be blended into one chemical composition with the additional appreciation that potential blending of incompatible components will be avoided. For example, those of ordinary skill in the art will appreciate that certain anionic surfactants may have to be avoided as some may be incompatible with certain sanitizing agents and/or certain anti-lime scale agents mentioned herein. Those of ordinary skill in the art will appreciate that the compatibility of the anionic surfactant and the various sanitizing and anti-limescale agents can be easily determined and thus incompatibility can be avoided in the situations.

The chemical treatment compositions may be formed of a single chemical treatment composition, or may formed of two (or more) different chemical treatment composition which may be provided as separate regions of a solid block, such as a first layer of a solid block consisting of a first chemical treatment composition, alongside a second layer of a second chemical treatment composition which is different than the first chemical treatment composition, such a solid block may also be formed of two or more separate blocks which are simply layered or otherwise assembled, without or without the use of an adhesive. Further layers of still further different chemical compositions may also be present. Such chemical treatment compositions formed having two or more discrete layers or regions of, respectively, two or more different chemical compositions or different chemical treatment compositions may be referred to as composite blocks.

The solid block according to the present invention may also be formed of two or more separate blocks which are simply layered or otherwise assembled, without or without the use of an adhesive. Alternately the solid block may be physically separated from one another such as by a plate or other physical barrier element forming part of the hanger, or more simply, by providing a simple gap between two masses or bodies of lavatory block compositions when they are applied to, or supplied to a hanger. Such latter embodiments provide a technique for using two chemically incompatible chemical treatment compositions as parts of a single dispensing device according to the invention.

Any form of the chemical treatment compositions may also be provided with a coating film or coating layer, such as a water soluble film which is used to overwrap the chemical composition provided in the device which film provides a vapor barrier when dry, but which dissolves when contacted with water. Alternately the chemical treatment compositions may be oversprayed or dipped into a bath of a water soluble film forming constituent, and thereafter removed and thus allowing the water soluble film forming constituent to dry and form a coating layer on the solid block.

Exemplary materials which may be used to provide such a coating on some or all of the surfaces of the chemical treatment compositions include one or more of the following: Rhodasurf TB-970 described by its supplier to be a tridecyl alcohol having a degree of ethoxylation of approximately 100 having an HLB of 19, and exhibiting a melting point in the range of 52-55° C.; Antarox F-108 which is described to be an EO-PO block copolymer having a degree of ethoxylation of approximately 80% and having a melting point in the range of 54-60° C.; further materials including those identified as Pluriol Z8000, and Pluriol E8000 which are believed to be optionally substituted, high molecular weight polyethylene glycols ("PEG") having a sufficiently high molecular weight such that they have a melting point of at least 25° C., preferably a melting point of at least about 30° C. may also be used. Other water soluble materials, desirably those which have a melting point in the range of about 30-70° C., and which may be used to provide a water soluble or water dispersible coating on the chemical treatment compositions are also contemplated to be useful, especially synthetic or naturally occurring waxy materials, and high molecular weight polyalkylene glycols, especially polyethylene glycols. Certain of these coating materials may be surfactants. Generally such materials may be provided as a dispersion in water, an organic solvent or in an aqueous/organic solvent, but preferably are used as supplied from their respective supplier and are heated to at least their melting points in order to form a liquid bath. Conveniently, the chemical treatment compositions affixed to the plate of a hanger are then conveniently dipped into the said bath, thereby providing a coating layer to the solid blocks. Alternately, the coating materials may be sprayed, brushed on or padded onto at least part of the surfaces of the previously formed solid blocks.

The application of a water soluble film or coating is preferred in certain embodiments of the invention as the surface film may facilitate the handling of the blocks during packaging and storage prior to use of the dispensing devices described herein.

The service life of the lavatory treatment devices of the invention are preferably from about 10 to about 30 days, based on approximately 12 flushes per day. Preferably the service life of the chemical treatment compositions present within the lavatory treatment devices is at least about 21 days when the device is installed in the overflow tube in the cistern, or tank, of a lavatory device, especially a toilet. Preferably the temperature of the water which is flushed is in the range of 16-24° C. The length of service life of the lavatory dispensing device of the invention will of course depend on a variety of factors including the specific formulation of the chemical treatment composition which it contains, water temperature, the number and frequency of flushes over the period of use and the volume of the water which contacts the chemical treatment compositions within the lavatory dispensing device.

Various configurations of dispensing devices according to the present invention, including certain particularly preferred embodiments, are depicted on the following figures. In the accompanying figures, like elements are indicated using the same numerals throughout the figures.

FIG. 1 depicts in a cross sectional view a toilet cistern (toilet tank). As is seen therein, the cistern 10 is a vessel adapted for a containing a quantity of water 12 which is used to flush a toilet bowl or other sanitary appliance which is attached to the toilet cistern 10. Interior of the cistern 10 is provided a refill device 14 which comprises a float 16 an inlet tube 18 and a cut off device 20 which operates to permit the inflow of water from an outside source into the interior 11 of the cistern 10. The cut off device 20 also operates to permit or to deny the delivery of water through an overflow conduit 22 which exits the refill device 14 via the overflow conduit 22, here depicted as a flexible tube, into the inlet 32 of the depicted lavatory dispensing device 30. As is visible from FIG. 1 and as is well recognized in the art, the overflow tube 24 has a top end 26 open to the interior 11 of the cistern 10 and at the opposite end thereof is second bottom end 30 in a mating, liquid tight connection to a valve 28 frequently referred to in the art as a "Douglas" valve. This bottom end 30 of the overflow tube 24 is typically connected to a portion of the body of the Douglas valve 28 by a liquid tight connection that passage of the cistern water 12 is denied, (except when a failure of the refill apparatus 14 occurs). As is seen, the bottom open end 30 is in fluid communication with the interior cavity 32 of the Douglas valve 28 such that, as is readily appreciated any water flowing into the upper open end 26 of the overflow tube 24 falls downwardly through the bottom open end 30, past the flap valve 34 and downwardly through the open cavity 32 wherein it ultimately passes to the bowl of a toilet or of a sanitary appliance (not shown).

As has been discussed previously in specification, during a flush cycle, the majority of the water 12 present in the tank cistern 10 is released by displacement in an upward direction of the flap valve 34 whereby, due to the difference in hydrostatic pressure, the bulk of the water 12 is suddenly released into the Douglas valve 28 where it flows outwardly from the cistern 10 and downwardly and into a toilet (or other sanitary appliance similarly configured). This concurrently causes the float 16 to fall downwardly and as the water 12 exits the cistern, the refill device 14 operates to admit water in order to reinstate the prior level of water within the cistern 10. As the flush cycle, that is to say the release of the bulk of the water 12 from the cistern 10 by opening the flap valve 34 is quite rapid and typically is on the order of the less than approximately 30 seconds, typically less than 20 seconds, a relatively small amount of water is admitted by the refill device 14 during the time that the flap valve 34 open. After the release of most of the water, the flap valve 34 closes under the influence of gravity and such signals the conclusion of the release phase of the flush cycle, and indicates the initiation of the refill phase of the flush cycle wherein water being admitted into the cistern 10 via the refill device 14 begins refilling of the cistern 10 as the flap valve 34 is closed thereby stopping the passage of water 12 out of the cistern 10. The operation of the refill device typically divides the quantity, that is to say the volumetric quantity, of water entering into a major portion which is normally directed into the interior cavity of the cistern 10 so that it can be rapidly refilled, and a minor portion being diverted through the overflow conduit 22. Such diversion and division of the volumetric quantity being admitted is purposeful in that at or near the end of the release phase of the flush cycle, as the sump of toilet is emptied by virtue of the flushing water 12, it is desirable to refill the level of water in the toilet sump (not shown) and this is readily done by admitting a stream of water during the refill phase via the overflow conduit 22 into the overflow tube 24 where it flows downwardly and ultimately refills the sump of the toilet bowl or sump of other lavatory device. Water is admitted into the interior of the cistern 10 as well as through the overflow conduit 22 until the level of the float 16 rises and cuts of the supply of water, at which time all supply of water to the cistern 10 ceases. Such ceases the supply of water to the overflow conduit 22 and the overflow tube 24, and also signals the end of the refill phase of the flush cycle as well as the end of a flush cycle. Thus, it is readily understood that water enters the overflow tube only intermittently during the operation of the lavatory device, namely only during a flush cycle. Therefore, according to the invention the positioning and use of the lavatory dispensing device taught herein intermediate the overflow conduit and the overflow tube directs the water provided from the overflow conduit 22 into the interior of the device 30, and provides for the formation of a the lavatory treatment composition and delivering the same to the toilet bowl wherein it is substantially retained between flush cycles and until the next flush cycle. Such thus provides for the effective retention of the chemical treatment composition within the toilet bowl wherein it may provide a long lasting benefit as between flush cycles, the lavatory treatment composition is retained in the toilet bowl in an essentially static state, and for an appreciable residence time. Such a residence time is dictated only by the intervals between flush cycles and is often under normal domestic use, usually at least 60 minutes, but may be even longer, e.g, 6-10 hours such as overnight where a toilet may not be flushed.

During the refill phase of a flush cycle, the flow of water being admitted via the overflow conduit 22 enters via the open end 31 of the inlet 32 of the lavatory dispensing device 30, wherein it is diverted by a diverter plate 34*a* in the direction indicated by arrow "a", causing the water to enter into the hollow cavity 35 wherein it comes into contact with a chemical treatment composition, here in the form of a compressed cylindrical tablet 40, wherein the water dissolves, elutes or entrains part of the compressed cylindrical tablet 40 which the water contacts and thus forms the lavatory treatment composition which flows out of the hollow cavity 35 into the overflow tube 24 wherein the lavatory treatment composition flows downwardly through the outlet 36 of the lavatory treatment device 30 and exits the same through the open end 37 of the outlet 36 in the direction indicated by arrows "b" through the overflow tube 24 and is provided directly into the sump of the toilet or other sanitary appliance. This chemical treatment composition may be a cleaning composition and/or a sanitizing composition, or any other composition which provides a treatment benefit to the toilet or other sanitary appliance. Thus, by virtue of the sequence of timed events, the delivery of a lavatory treatment composition is provided to the sump of a toilet bowl or other sanitary appliance at a particularly beneficial point in the flush cycle, namely during the refill phase of the flush cycle which thus provides that the resultant lavatory treatment composition may be resident in the sump of the toilet bowl between uses of the toilet or sanitary appliance, more specifically between flush cycles.

FIG. 1 depicts the preferred mode of placement of the dispensing device according the invention with respect of the overflow tube 24. As is seen in the cross sectional view provided, the lavatory dispensing device 30 is wholly suspended upon the open top end 26 of the overflow tube 24 by a linear gap 38 present between the outlet 36 and the base 39*a* of the device 30, such that at least a part of the overflow tube 24 an especially its outlet 37 is within the interior of the overflow tube 24 and the outlet 37 is directed downwardly in a direction away from the open end 26 of the overflow tube 24. In this cross sectional view is also visible the interior of the device 30, including the filled volume of the device which corresponds to the volume of the hollow cavity 35 which exists between the base 39*a* of the device and extends upward towards the top 39*b* of the device to the level of the base of the outlet 36*b* of the lavatory treatment device. It is also visible that the quantity of the lavatory treatment composition TC within the base 39*a* and defining the fill level is physically isolated from the bulk of the water 12 present in the cistern 10. While not illustrated a retention means may also be provided for use with the device 30, or may form part of the device 30, such as one or more springs, or leaf springs which are at least partially elastic and which may be present in the linear gap 38 to provide improved retention of the device 30 when it is installed in the manner depicted. FIG. 1 depicts the preferred mode of installation and use of the preferred embodiments of the present invention in all manner and forms as described in the following figures, although it is recognized that alternative methods of supplying the dispensing device of the invention within an overflow tube may also be practiced.

Figure 2:
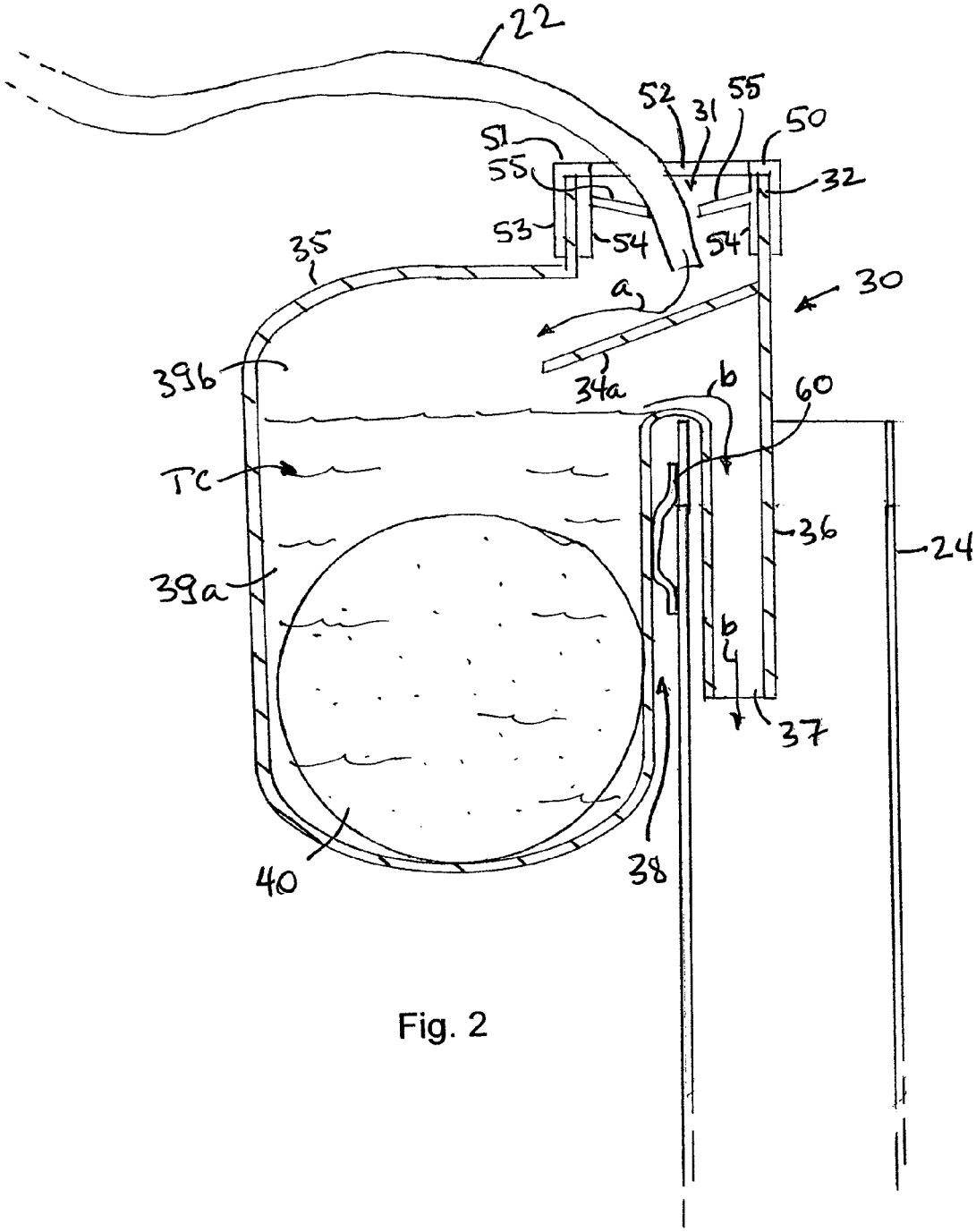

Turning now to FIG. 2, therein is depicted in greater detail in a cross sectional view a preferred embodiment of a dispensing device fully according to the present invention, which is similar in most respects with that depicted on FIG. 1, illustrated as mounted on an overflow tube 24. The lavatory dispensing device 30 further includes a retaining overcap 50 which is mounted on the open end 31 of the inlet 32. The retaining overcap 50 includes a top part 51 which includes a center opening 52 through which the overflow conduit 22 extends, an external sidewall 53 which depends downwardly from the top part 51, and an internal sidewall 54 which depends downwardly from the top part 51 and having dependent therefrom one or more (here two are depicted) gripping elements 55 which are small, somewhat flexible plate elements which are directed into towards the center of the inlet 32, and function to releasably retain the overflow tube 24 when it is inserted into the retaining overcap 50 and the inlet 32. The lavatory dispensing device 30 also includes a retention means here, a leaf spring 60 positioned within the linear gap 38 present between the outlet 36 and the base 39*a* of the device 30. As is seen therefrom the ends of the leaf spring 60 press against a part of the overflow tube 24.

Figure 3:
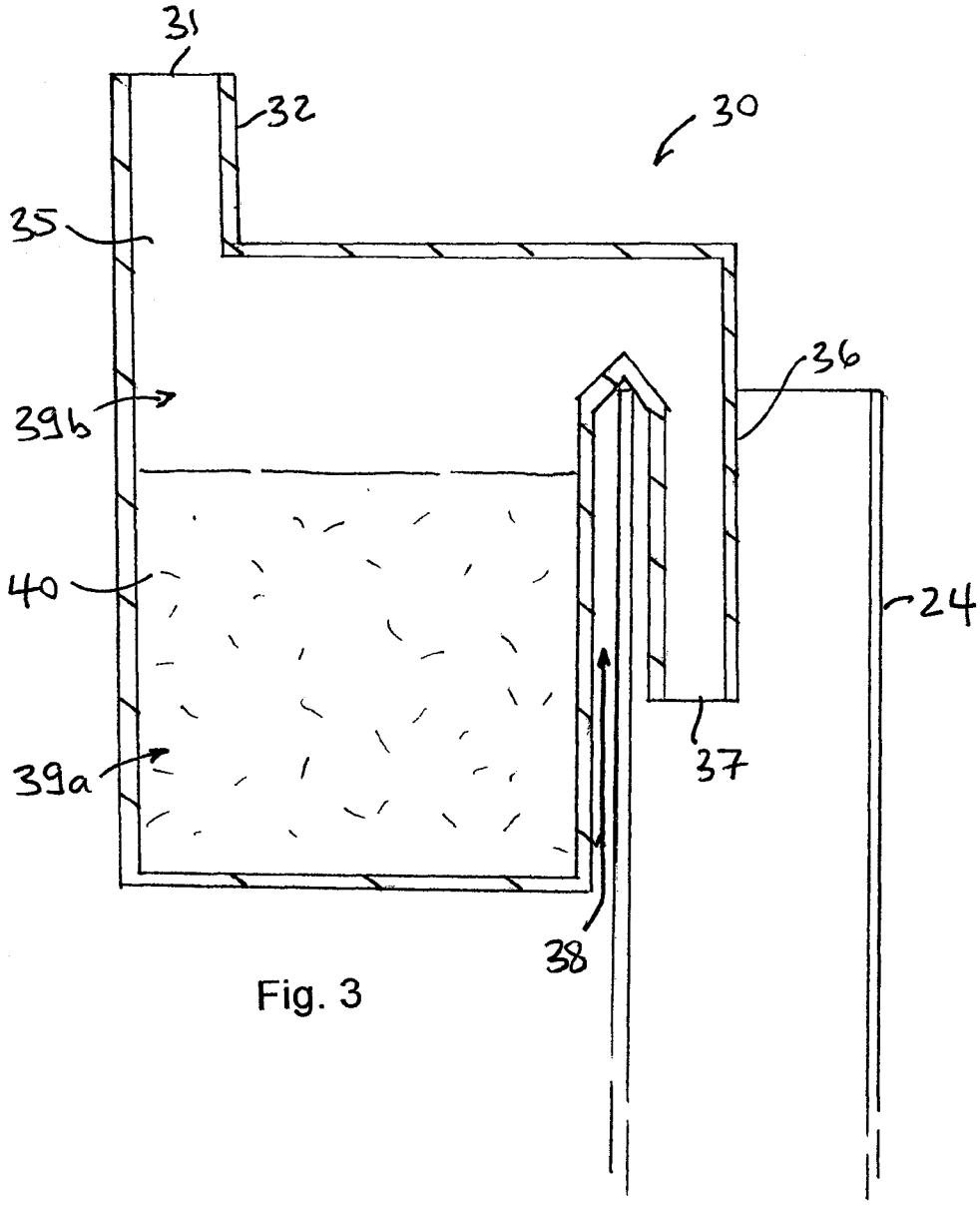

FIG. 3 illustrates an alternative embodiment of a lavatory dispensing device 30 of the invention wherein the inlet tube 32 is transversely positioned with respect to the outlet 36, and further, wherein the chemical treatment composition is formed in-situ within the bottom 39*a* of the hollow cavity 35 of said device 30. The respective positioning of the inlet tube 32 as depicted obviates the need for a diverter plate as all water entering through the upwardly directed open end 31 of the inlet necessarily transits into the hollow cavity before exiting via the downwardly directed open end 37 of the outlet 36. An advantage of the use of an in-situ formed chemical treatment composition resides in the fact that only the top surface of the chemical treatment composition is exposed to the water contained in the hollow cavity, as opposed to other forms of the chemical treatment composition. Thus, dissolution or erosion of such an in-situ formed chemical treatment composition 40 occurs only at its top surface wherein it contacts the water. Such may provide a more uniform dissolution profile of the chemical treatment composition 40, and the delivery of a more consistent lavatory treatment composition over the service life of the device.

Figure 4A:
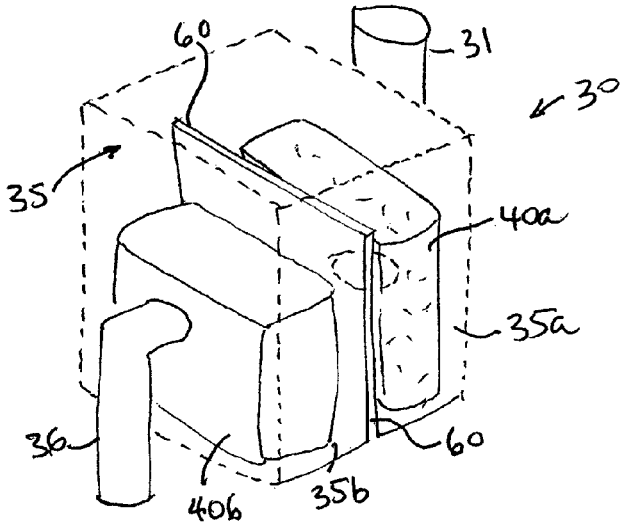
Figure 4B:
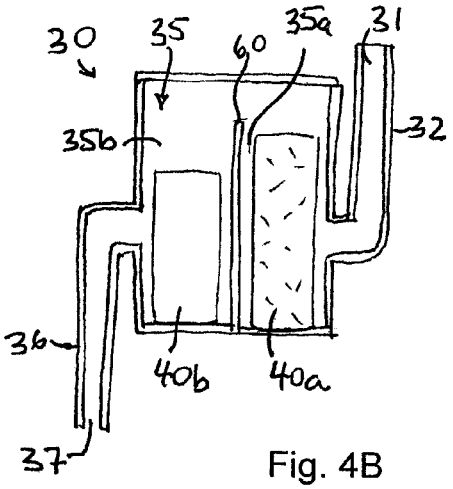

FIGS. 4A and 4B illustrate two views of a further embodiment of a lavatory treatment device 30 according to the invention, the first being a partial perspective view and the second in a cross sectional view. Referring first to FIG. 4A, there is depicted a lavatory dispensing device 30 having an hollow cavity 35 which is partially divided into a first hollow cavity part 35*a* and as second hollow cavity part 35*b* by a divider means 60 here a wall contiguous with the bottom wall and two sidewalls of the device 30. Present in the first hollow cavity part 35*a* is a first chemical treatment composition 40*a*, in the form of a cake or tablet which is kept separated from a second chemical treatment composition 40*b* also in the form of a cake or tablet present in the second hollow cavity part 35*b*. This relationship is also depicted in FIG. 4B. Such a form of the lavatory dispensing device 30 may be particularly useful wherein it is desired to form two lavatory treatment compositions which are respectively formed form the first chemical treatment composition 40*a* in the first hollow cavity part 35*a*, and the second chemical treatment composition 40*b* in the second hollow cavity part 35*b*, and which are kept separate between flush cycles. However, during a flush cycle, water entering the device 30 through the open end 31 of the inlet 32 forces water into the first hollow cavity part 35*a* and also the first lavatory treatment composition over the top end of the divider means 60 wherein it spills into the second hollow cavity part 35*b* and mixes with the second lavatory treatment composition present therein, causing the first lavatory treatment composition to mix with the second lavatory treatment composition to form an ultimate lavatory treatment composition which exits out of the open end 37 of the outlet 36 into an overflow tube and then to a toilet bowl (both not shown in the figures). In such an embodiment of the lavatory dispensing device 30, two chemically incompatible chemical treatment compositions and/or lavatory treatment compositions may be formed and kept physically isolated from one another until they are sequentially mixed during the flush cycle. For example, such a device 30 may be used wherein the first chemical treatment composition 40*a* is a bleach block, and the second chemical treatment composition 40*b* is a block containing a colorant, e.g., a dye which would otherwise be bleached if kept in contact with the first lavatory treatment composition formed from the bleach block. Use of the embodiment of the lavatory dispensing device 30 shown ensures that any contact with the bleach containing, first lavatory treatment composition formed from the bleach block, and the second, colorant containing, second lavatory treatment composition formed from the block containing a colorant is for only a few seconds prior to being delivered through the overflow tube 24 and thereafter into the toilet bowl. Such may permit for the delivery of a bleach containing, but colored lavatory treatment composition to a toilet bowl which may however lose its visual color over time, thus providing a visually discernible benefit.

Figure 4C:
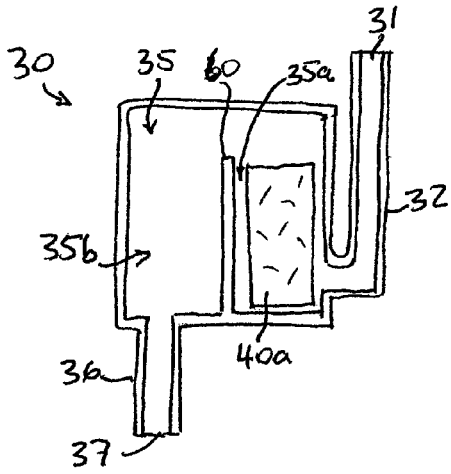

FIG. 4C illustrates a further embodiment of a lavatory dispensing device 30 according to the invention which includes many features similar to those described with reference to the device described with reference to FIGS. 4A and 4B. The device 30 depicted on FIG. 4C includes a hollow cavity 35 which is partially divided into a first hollow cavity part 35*a* and as second hollow cavity part 35*b* by a divider means 60 here a wall contiguous with the bottom wall and two sidewalls of the device 30, but from the device described with reference to FIGS. 4A and 4B in that a second chemical treatment composition (40*b*) is omitted from the second hollow cavity part 35*b*, and that the outlet 36 extends downwardly from the base of the device 30 from within the second hollow cavity part 35*b* such that between flush cycles, the liquid contents of the second hollow cavity part 35*b* are drained between flush cycles.

While not illustrated with reference to FIG. 4C, it is nonetheless to be understood that a second chemical treatment composition (40*b*) may be included within the second hollow cavity part 35*b* if desired.

Figure 5A:
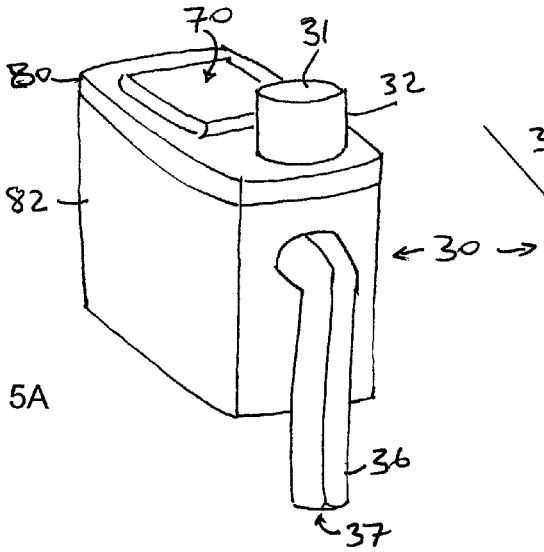
Figure 5B:
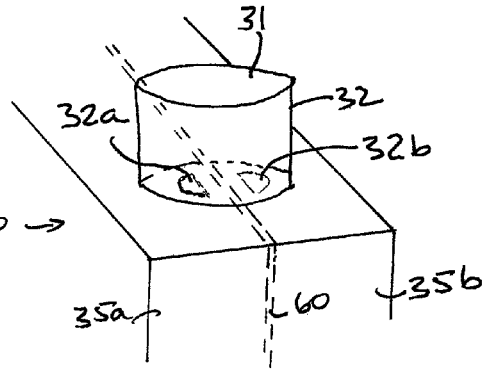
Figure 5C:
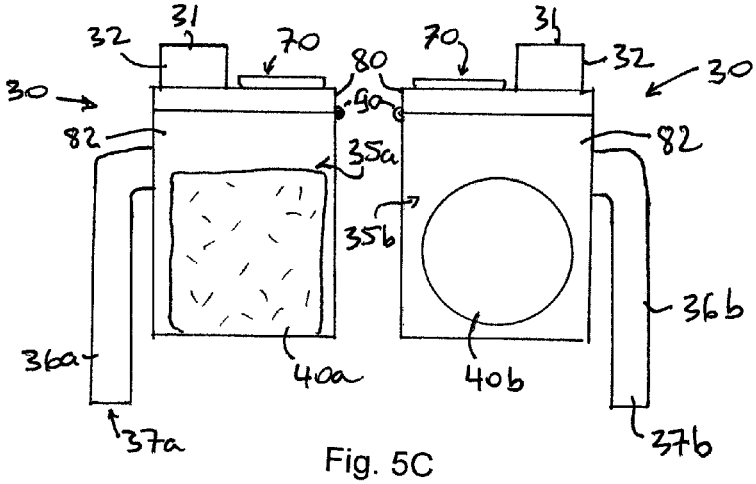

FIGS. 5A, 5B and 5C depict three views of a further embodiment of a lavatory treatment device 30 divided into a first hollow cavity part 35*a* and as second hollow cavity part 35*b* by a divider means, here a wall 60 contiguous with the bottom wall, two sidewalls and with the top of the device 30, such that the hollow cavity part 35 is completely divided. Present in the first hollow cavity part 35*a* is a first chemical treatment composition 40*a*, in the form of a cake or tablet which is kept separated from a second chemical treatment composition 40*b* also in the form of a cake or tablet present in the second hollow cavity part 35*b* by the wall 60. The device 30 also includes on a top surface thereof an air treatment means 70 which may be used to provide an air treatment effect or a fragrance to the environment of the device 30. Such may be a pad or gel containing a quantity of a volatile material, such as a fragrance, insecticide, air sanitization agent, or the like. The lavatory treatment device 30 includes a top cap part 80 hingedly affixed to the bottom body part 80 which together define the interior hollow cavity 35, or more specifically in conjunction with the wall 60 define the first hollow cavity part 35*a* and second hollow cavity part 35*b*. Means for dividing the flow of water into the device 30, namely a construction of the inlet 32 which includes two separate and preferably equally sized inlet orifices 32*a*, 32*b* which respectively provide water into the respective first hollow cavity part 35*a* and second hollow cavity part 35*b*. Such permits for the division of water flowing into the device 30, but continues to keep the first hollow cavity part 35*a* and second hollow cavity part 35*b* isolated from one another. FIG. 5C depicts a "broken-apart" depiction of the lavatory dispensing device 30 along the midline of the wall 60. As is visible thereon, the first hollow cavity part 35*a* contains a first chemical treatment composition 40*a*, while the second hollow cavity part 35*b* contains a second chemical treatment composition 40*b*, here both in the form of tablets or cakes. Hinge 90 is present to provide a joint which connects top cap part 80 hingedly to the bottom body part 80. In use, a first lavatory treatment composition formed by the contact of water and the first chemical treatment composition 40*a* present in the first hollow cavity part 35*a* exits the device via a first outlet 36*a* and through the open end 37*a* thereof, and concurrently a second lavatory treatment composition formed by the contact of water and the second chemical treatment composition 40*b* present in the second hollow cavity part 35*b* exits the device via a second outlet 36*b* and through the open end 37*b* thereof, wherein the stream of the first lavatory treatment composition and the stream of the second lavatory treatment composition first intermix. While not illustrated it is to be understood that the lavatory dispensing device 30 is mounted via its outlet element 36, here the combined first outlet 36*a* and second outlet 36*b*, on an overflow tube 34 in a manner hereintofore described, e.g. FIG. 2. Accordingly the present embodiment of FIGS. 5A, 5B and 5C provide an embodiment wherein two separate lavatory treatment compositions are separately formed and maintained within the device 30 in a parallel type relationship, and only are mixed together to form the ultimate lavatory treatment composition after streams of the two separate lavatory treatment compositions exit the device 30 and intermix.

With regard to the foregoing embodiments described herein it is to be understood that part or elements of one embodiment can be substituted for related part or elements in different embodiments.

It is to be understood that a lavatory dispensing device as disclosed herein may also have a different geometry, configuration or and appearance than the embodiments described in the Figures and still be considered to fall within the scope of the invention.

In a further aspect of the present invention there is also provided a process for delivering a treatment composition to a sanitary appliance, especially preferably, to the interior of a toilet bowl, and still more preferably to the sump of the toilet bowl or other sanitary appliance. This process includes the steps of: providing a lavatory dispensing device as described hereinabove to the cistern of a toilet or other lavatory appliance having an overflow tube wherein at least a part of the lavatory dispensing device is inserted in to the interior of the overflow tube, and, periodically supplying water through the lavatory treatment device in order to form a lavatory treatment composition with said water which lavatory treatment composition is used to treat a part of the sanitary appliance downstream of the overflow tube, preferably the interior of a toilet bowl.

The foregoing process may be practiced to provide a cleaning treatment and/or a sanitizing or disinfecting treatment to the toilet bowl or a part thereof, or alternately to a part of a sanitary appliance.

Preferably the foregoing process is practiced such that at least 60%, preferably at least 70%, and more preferably at least 80% of the water provided to the overflow tube during a flush cycle is provided subsequent to the release of water from the cistern to the interior of the toilet bowl, particularly via a valve, whereby at least 60%, preferably at least 70%, and more preferably at least 80% of the treatment composition formed by contacting the chemical treatment composition with water is provided to the toilet bowl or lavatory appliance following the closing of the valve during the flush cycle.

In order to further illustrate the present invention, various examples of preferred embodiments of the invention are described, following. In these examples, as well as throughout the balance of this specification and claims, all parts and percentages are by weight unless otherwise indicated.

EXAMPLES

Three identical lavatory dispensing devices generally in accordance with the embodiment of FIG. 2 was supplied and contained within its interior a compressed solid block of a chemical treatment composition commercially available as (ex. Lonza) having the following composition:

- 98% wt. of a mixture of 3-Bromo-1-Chloro-5,5-dimethylhydantoin, bromochloro-5,5-dimethylhydantoin, 1,3-dichloro-5,5-dimethylhydantoin, 1,3-dichloro-5-ethyl-5-methylhydantoin
- 1.5% wt. sodium chloride
- 0.5% wt. moisture.

Each of the dispensing devices were mounted on the overflow tubes present in the cistern of three identical toilets, namely model "Cadet" toilets (ex. American Standard) and the tube which functioned as the overflow conduit of the refill device was inserted into the inlet of each of the devices, a generally depicted on FIG. 2. Each of the toilets were periodically and automatically flushed by a machine-controlled device which operated the toilets to flush 12 times daily at intervals of approximately 120 minutes between flushes. It was determined by measurement that during each flush cycle, approximately 2.3 liters of water was provided via the overflow conduit and into the overflow tube in which the lavatory dispensing device were mounted.

Following the specific number of flushes indicated on the following table the amounts of halohydantoin compounds (listed as "active" in parts per million) present in the liquid in the sump of the toilet bowl, as well as the pH of the said liquid in the sump of the toilet, were evaluated. The results are reported on the following Table:

| Flush # | Toilet A (ppm active in bowl) | Toilet B (ppm active in bowl) | Toilet C (ppm active in bowl) | Toilet A (pH) | Toilet B (pH) | Toilet C (pH) |
|---|---|---|---|---|---|---|
| 25 | 4.9 | 3.7 | 3.6 | 7.41 | 7.47 | 7.42 |
| 49 | 3.7 | 4.5 | 5.5 | 7.45 | 7.43 | 7.2 |
| 85 | 2 | 2.4 | 2.9 | 7.45 | 7.41 | 7.47 |
| 109 | 2.1 | 2.1 | 2.9 | 7.27 | 7.27 | 7.29 |
| 133 | 1.8 | 2 | 2.3 | 7.31 | 7.3 | 7.35 |
| 150 | 3 | 3 | 4.1 | 7.39 | 7.37 | 7.45 |
| 176 | 2.3 | 2 | 2.7 | 7.3 | 7.31 | 7.37 |
| 200 | 1.8 | 1.7 | 2.8 | 7.31 | 7.31 | 7.28 |
| 236 | 1.8 | 1.7 | 2 | 7.39 | 7.39 | 7.41 |
| 260 | 1.8 | 2.7 | 2.3 | 7.4 | 7.4 | 7.4 |
| 284 | 2.1 | 2.1 | 2.4 | 7.39 | 7.39 | 7.3 |
| 300 | 1.4 | 1.5 | 1.7 | 7.36 | 7.38 | 7.31 |
| 326 | 1 | 1.4 | 0.7 | 7.57 | 7.57 | 7.42 |
| 349 | 1.3 | 0.7 | 1 | 7.39 | 7.35 | 7.54 |
| 387 | 2 | 2 | 2.2 | 7.46 | 7.51 | 7.43 |
| 411 | 2.1 | 2.1 | 2.4 | 7.39 | 7.44 | 7.36 |
| 435 | 1.6 | 1.6 | 2 | 7.98 | 7.98 | 7.78 |
| 453 | 2.5 | 2.1 | 2.4 | 7.45 | 7.41 | 7.74 |
| 481 | 1.8 | 1.6 | 2.2 | 7.52 | 7.51 | 7.44 |
| 507 | 1.6 | 1.4 | 1.52 | 7.42 | 7.42 | 7.4 |
| 546 | 1.13 | 1.16 | 1.36 | 7.45 | 7.5 | 7.47 |
| 570 | 1.54 | 1.47 | 1.57 | 7.41 | 7.47 | 7.45 |
| 594 | 1.41 | 1.48 | 1.41 | 7.41 | 7.4 | 7.44 |
| 632 | 1.24 | 1.34 | 1.41 | 7.41 | 7.44 | 7.4 |
| 645 | 1.3 | 1.31 | 1.73 | 7.51 | 7.34 | 7.37 |
| 671 | 1.16 | 0.98 | 1.67 | 8.18 | 8.18 | 8.13 |
| 710 | 1.25 | 1.02 | 1.45 | 7.59 | 7.89 | 7.55 |
| 734 | 1.19 | 0.9 | 1.53 | 7.59 | 7.86 | 7.81 |
| 758 | 1.09 | 0.82 | 1.43 | 7.51 | 7.59 | 7.54 |
| 827 | 1.07 | 0.89 | 1.07 | 7.58 | 7.6 | 7.66 |
| 858 | 1.11 | 0.92 | 1.09 | 7.6 | 7.59 | 7.72 |
| 894 | 0.89 | 0.8 | 0.91 | 7.62 | 7.6 | 7.68 |
| 918 | 0.85 | 0.76 | 0.89 | 7.58 | 7.6 | 7.52 |

As is evident from the foregoing, each of the devices delivered at least 0.6 parts per million of the halohydantoin compounds at 918 flush cycles.

While the invention is susceptible of various modifications and alternative forms, it is to be understood that specific embodiments thereof have been shown by way of example in the drawings which are not intended to limit the invention to the particular forms disclosed; on the contrary the intention is to cover all modifications, equivalents and alternatives falling within the scope and spirit of the invention as expressed in the appended claims.

The invention claimed is:

1. A lavatory dispensing device adapted to be installed in a toilet and used for the delivery of at least one treatment composition to a toilet bowl which device comprises:

a non-pressurizable lavatory dispensing device comprising a hollow body having an inlet located along or at the top surface of the device which inlet is open to the ambient environment of the toilet, an outlet also open to the ambient environment of the toilet in which it is adapted to be installed, said hollow body defining an interior cavity having a headspace which is open to the ambient atmosphere within the interior of the cistern before, during, and after a flush cycle of the toilet, said interior cavity adapted to contain a quantity of a chemical treatment composition as well as a quantity of water which are to be provided to the interior of said hollow body via the inlet, wherein the outlet of the device is adapted to be inserted at least partially into the interior of an overflow tube present in the cistern of a toilet and whereby the said hollow body is suspended downwardly from the top open end of the overflow tube.

2. A lavatory dispensing device according to claim 1 wherein said device is of a sealed construction and cannot be opened by a consumer or other user once the lavatory dispensing device is assembled.

3. A lavatory dispensing device according to claim 1 wherein the inlet and the outlet are both located at one side of the hollow body.

4. A lavatory dispensing device according to claim 1 wherein the device includes a flow diverter means.

5. A lavatory dispensing device according to claim 4 wherein the flow diverter means is a divider plate.

6. A lavatory dispensing device according to claim 1 wherein the both the inlet and the outlet are unobstructed by the chemical treatment composition present within the interior of the lavatory dispensing device.

7. A lavatory dispensing device according to claim 1 wherein the hollow cavity is a divided hollow cavity.

8. A lavatory dispensing device according to claim 1 wherein the chemical treatment composition is a cleaning composition or a sanitizing composition.

9. A process for delivering a treatment composition to the interior of a toilet bowl, which includes the steps of: providing a lavatory dispensing device according to claim 1 to the cistern of a toilet having an overflow tube wherein at least a part of the lavatory dispensing device is inserted in to the interior of the overflow tube, and, periodically supplying water through the lavatory treatment device in order to form a lavatory treatment composition with said water which lavatory treatment composition is used to treat a the interior of a toilet bowl.

10. A lavatory dispensing device according to claim 1 wherein water and the at least one treatment composition present within the interior cavity are present in a respective volumetric ratio of at least 1:2.

11. A lavatory dispensing device according to claim 10, wherein the respective volumetric ratio is at least 1:1.

* * * * *